US011105352B2

(12) United States Patent
Anand et al.

(10) Patent No.: US 11,105,352 B2
(45) Date of Patent: Aug. 31, 2021

(54) ARTICLES AND METHODS FOR LEVITATING LIQUIDS ON SURFACES, AND DEVICES INCORPORATING THE SAME

(71) Applicant: Massachusetts Institute of Technology, Cambridge, MA (US)

(72) Inventors: Sushant Anand, Somerville, MA (US); Kripa K. Varanasi, Lexington, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 16/137,087

(22) Filed: Sep. 20, 2018

(65) Prior Publication Data

US 2019/0226506 A1 Jul. 25, 2019

Related U.S. Application Data

(63) Continuation of application No. 15/417,094, filed on Jan. 26, 2017, now abandoned, which is a (Continued)

(51) Int. Cl.
*F15D 1/00* (2006.01)
*B01L 3/00* (2006.01)

(52) U.S. Cl.
CPC ..... *F15D 1/0065* (2013.01); *B01L 3/502746* (2013.01); *B01L 3/502769* (2013.01); (Continued)

(58) Field of Classification Search
CPC ..... B01L 2200/0626; B01L 3/502769; F16K 99/0032; F15D 1/0065
See application file for complete search history.

(56) References Cited

U.S. PATENT DOCUMENTS 4,069,933 A 1/1978 Newing
4,125,152 A 11/1978 Kestner et al.
(Continued)

FOREIGN PATENT DOCUMENTS

CN 100344341 C 10/2007
CN 101269960 B 5/2011
(Continued)

OTHER PUBLICATIONS

International Search Report and Written Opinion for application PCT/US2011/061498 dated Jul. 31, 2012.
(Continued)

*Primary Examiner* — Reinaldo Sanchez-Medina
*Assistant Examiner* — Nicole Gardner
(74) *Attorney, Agent, or Firm* — Wolf, Greenfield & Sacks, P.C.

(57) ABSTRACT

Methods described herein provide a way to reduce or eliminate drag and adhesion of a substance flowing over a surface by creating a vapor cushion via evaporation of a phase-changing material of or on the surface or encapsulated within textures of the surface. The vapor cushion causes the flowing substance to be suspended over the surface, greatly reducing friction, drag, and adhesion between the flowing substance and the surface. The temperature of the flowing substance is above the sublimation point and/or melting point of the phase-changing material. The phase-changing material undergoes a phase change (evaporation or sublimation) upon contact with the flowing substance due to local heat transfer from the flowing substance to the material, generating a vapor cushion between the solid or liquid material and the flowing substance.

26 Claims, 13 Drawing Sheets

Related U.S. Application Data continuation of application No. 13/917,585, filed on Jun. 13, 2013, now abandoned.

(60) Provisional application No. 61/659,400, filed on Jun. 13, 2012.

(52) U.S. Cl.
CPC ..... *B01L 2200/0626* (2013.01); *B01L 2400/0469* (2013.01); *Y10T 137/0391* (2015.04)

(56) References Cited

U.S. PATENT DOCUMENTS

| | | | | |
|---|---|---|---|---|
| 4,204,021 | A | 5/1980 | Becker | |
| 4,316,745 | A | 2/1982 | Blount | |
| 4,503,099 | A | 3/1985 | Chang et al. | |
| 5,154,741 | A | 10/1992 | da Costa Filho | |
| 5,327,998 | A * | 7/1994 | Rosado | F16C 33/6696 184/104.1 |
| 5,624,713 | A | 4/1997 | Ramer | |
| 5,816,280 | A | 10/1998 | Rojey et al. | |
| 5,817,898 | A | 10/1998 | Delion et al. | |
| 5,853,802 | A | 12/1998 | Boyer et al. | |
| 5,900,516 | A | 5/1999 | Talley et al. | |
| 5,936,040 | A | 8/1999 | Costello et al. | |
| 6,028,234 | A | 2/2000 | Heinemann et al. | |
| 6,093,862 | A | 7/2000 | Sinquin et al. | |
| 6,216,472 | B1 | 4/2001 | Cathenaut et al. | |
| 6,329,490 | B1 | 12/2001 | Yamashita et al. | |
| 6,389,820 | B1 | 5/2002 | Rogers et al. | |
| 6,763,675 | B1 | 7/2004 | Fleeman | |
| 7,041,363 | B2 | 5/2006 | Krohmer et al. | |
| 7,323,221 | B2 | 1/2008 | Heppekausen et al. | |
| 7,458,384 | B1 | 12/2008 | Seal et al. | |
| 7,597,148 | B2 | 10/2009 | O'Malley et al. | |
| 7,622,197 | B2 | 11/2009 | Balow et al. | |
| 7,687,593 | B2 | 3/2010 | Yamahiro et al. | |
| 7,722,951 | B2 | 5/2010 | Li et al. | |
| 7,887,934 | B2 | 2/2011 | Gentleman et al. | |
| 7,892,660 | B2 | 2/2011 | Gentleman et al. | |
| 7,897,271 | B2 | 3/2011 | Gentleman et al. | |
| 7,901,798 | B2 | 3/2011 | Gentleman et al. | |
| 7,977,267 | B2 | 7/2011 | Gentleman et al. | |
| 7,985,451 | B2 | 7/2011 | Luzinov et al. | |
| 8,057,922 | B2 | 11/2011 | Gentleman et al. | |
| 8,057,923 | B2 | 11/2011 | Gentleman et al. | |
| 8,062,775 | B2 | 11/2011 | Gentleman et al. | |
| 8,173,279 | B2 | 5/2012 | Gentleman et al. | |
| 8,178,219 | B2 | 5/2012 | Gentleman et al. | |
| 8,222,172 | B2 | 7/2012 | Gentleman et al. | |
| 8,235,096 | B1 | 8/2012 | Mahefkey et al. | |
| 8,236,432 | B2 | 8/2012 | Gentleman et al. | |
| 8,252,259 | B2 | 8/2012 | Seal et al. | |
| 8,574,704 | B2 | 11/2013 | Smith et al. | |
| 8,859,090 | B2 | 10/2014 | Angelescu et al. | |
| 2002/0164443 | A1 | 11/2002 | Oles et al. | |
| 2003/0017303 | A1 | 1/2003 | Sindo et al. | |
| 2003/0134035 | A1 | 7/2003 | Lamb et al. | |
| 2003/0203117 | A1 | 10/2003 | Bartkowiak et al. | |
| 2003/0226806 | A1 | 12/2003 | Young et al. | |
| 2004/0026832 | A1 | 2/2004 | Gier et al. | |
| 2004/0037961 | A1 | 2/2004 | Dileman et al. | |
| 2004/0219373 | A1 | 11/2004 | Deruelle et al. | |
| 2004/0243249 | A1 | 12/2004 | Ishihara et al. | |
| 2005/0003146 | A1 | 1/2005 | Spath | |
| 2005/0009953 | A1 | 1/2005 | Shea | |
| 2005/0016489 | A1 | 1/2005 | Endicott et al. | |
| 2005/0061221 | A1 | 3/2005 | Paszkowski | |
| 2005/0112326 | A1 | 5/2005 | Nun et al. | |
| 2005/0136217 | A1 | 6/2005 | Barthlott et al. | |
| 2005/0208272 | A1 | 9/2005 | Groll | |
| 2006/0007515 | A1 | 1/2006 | Simonian et al. | |
| 2006/0013735 | A1 | 1/2006 | Engelking et al. | |
| 2006/0078724 | A1 | 4/2006 | Bhushan et al. | |
| 2006/0147675 | A1 | 7/2006 | Nun et al. | |
| 2006/0204738 | A1 | 9/2006 | Dubrow et al. | |
| 2006/0240218 | A1 | 10/2006 | Parce | |
| 2006/0246226 | A1 | 11/2006 | Dai et al. | |
| 2007/0031639 | A1 | 2/2007 | Hsu et al. | |
| 2007/0135602 | A1 | 6/2007 | Yamahiro et al. | |
| 2007/0207335 | A1 | 9/2007 | Karandikar et al. | |
| 2007/0231542 | A1 | 10/2007 | Deng et al. | |
| 2007/0026193 | A1 | 12/2007 | Jung et al. | |
| 2007/0282247 | A1 | 12/2007 | Desai et al. | |
| 2007/0298216 | A1 | 12/2007 | Jing et al. | |
| 2008/0085070 | A1 | 4/2008 | Hirata et al. | |
| 2008/0118763 | A1 | 5/2008 | Balow et al. | |
| 2008/0213461 | A1 | 9/2008 | Gill et al. | |
| 2008/0225378 | A1 | 9/2008 | Weikert et al. | |
| 2009/0124520 | A1 | 5/2009 | Tohidi | |
| 2009/0155609 | A1 | 6/2009 | Gentleman et al. | |
| 2009/0185867 | A1 | 7/2009 | Masters et al. | |
| 2009/0211735 | A1 | 8/2009 | Stenkamp et al. | |
| 2009/0231273 | A1 | 9/2009 | Lashina et al. | |
| 2009/0289213 | A1 | 11/2009 | Pipper | |
| 2010/0028604 | A1 | 2/2010 | Bhushan et al. | |
| 2010/0092621 | A1 | 4/2010 | Akutsu et al. | |
| 2010/0098909 | A1 | 4/2010 | Reyssat et al. | |
| 2010/0112286 | A1 | 5/2010 | Bahadur et al. | |
| 2010/0147441 | A1 | 6/2010 | Nakagawa et al. | |
| 2010/0151197 | A1 | 6/2010 | Gentleman et al. | |
| 2010/0180952 | A1 | 7/2010 | Verhelst et al. | |
| 2010/0200094 | A1 | 8/2010 | Ermakov | |
| 2010/0285229 | A1 | 11/2010 | Elbahri et al. | |
| 2010/0285275 | A1 | 11/2010 | Baca et al. | |
| 2010/0307922 | A1 | 12/2010 | Wu | |
| 2010/0330146 | A1 | 12/2010 | Chauhan et al. | |
| 2011/0042850 | A1 | 2/2011 | Hong et al. | |
| 2011/0077172 | A1 | 3/2011 | Aizenberg et al. | |
| 2011/0106504 | A1 | 5/2011 | Noureldin | |
| 2011/0201984 | A1 | 8/2011 | Dubrow et al. | |
| 2011/0226998 | A1 | 9/2011 | Van De Weijer-Wagemans et al. | |
| 2011/0240130 | A1 | 10/2011 | Den Dulk et al. | |
| 2011/0283778 | A1 | 11/2011 | Angelescu et al. | |
| 2011/0287217 | A1 | 11/2011 | Mazumder et al. | |
| 2012/0036846 | A1 | 2/2012 | Aizenberg et al. | |
| 2012/0128963 | A1 | 5/2012 | Mao et al. | |
| 2012/0248020 | A1 | 10/2012 | Granick et al. | |
| 2013/0003258 | A1 | 1/2013 | Xie et al. | |
| 2013/0032316 | A1 | 2/2013 | Dhiman et al. | |
| 2013/0034695 | A1 | 2/2013 | Smith et al. | |
| 2013/0062285 | A1 | 3/2013 | Hoek et al. | |
| 2013/0220813 | A1 | 8/2013 | Anand et al. | |
| 2013/0251769 | A1 | 9/2013 | Smith et al. | |
| 2013/0251942 | A1 | 9/2013 | Azimi et al. | |
| 2013/0251946 | A1 | 9/2013 | Azimi et al. | |
| 2013/0251952 | A1 | 9/2013 | Smith et al. | |
| 2013/0333789 | A1 | 12/2013 | Smith et al. | |
| 2013/0335697 | A1 | 12/2013 | Smith et al. | |
| 2013/0337027 | A1 | 12/2013 | Smith et al. | |
| 2014/0141263 | A1 | 5/2014 | Jones et al. | |
| 2014/0147627 | A1 | 5/2014 | Aizenberg et al. | |
| 2014/0291420 | A1 | 10/2014 | Dhiman et al. | |
| 2015/0111063 | A1 | 4/2015 | Khan et al. | |
| 2015/0125575 | A1 | 5/2015 | Smith et al. | |
| 2015/0306642 | A1 | 10/2015 | Smith et al. | |

FOREIGN PATENT DOCUMENTS

| | | | |
|---|---|---|---|
| DE | 198 18 956 | A1 | 11/1998 |
| EP | 0230112 | A2 | 7/1987 |
| EP | 1892458 | A1 | 2/2008 |
| JP | H01-170932 | A | 7/1989 |
| JP | H05-240251 | A | 9/1993 |
| JP | 2004 037764 | A | 2/2004 |
| JP | 2007 278090 | A | 10/2007 |
| JP | 2008 223003 | A | 9/2008 |
| JP | 2008 240910 | A | 10/2008 |
| TW | I 233 968 | B | 6/2005 |
| WO | WO 93/17077 | A1 | 9/1993 |
| WO | WO 99/36490 | A1 | 7/1999 |
| WO | WO 2002/062568 | A2 | 8/2002 |

(56) References Cited

FOREIGN PATENT DOCUMENTS

| | | | |
|---|---|---|---|
| WO | WO 2003/071275 | A1 | 8/2003 |
| WO | WO 2006/0007515 | A1 | 1/2006 |
| WO | WO 2006/017009 | A2 | 2/2006 |
| WO | WO 2006/091235 | A1 | 8/2006 |
| WO | WO 2006/132892 | A2 | 12/2006 |
| WO | WO 2007/019362 | A1 | 2/2007 |
| WO | WO 2008/111603 | A1 | 9/2008 |
| WO | WO 2009/009185 | A2 | 1/2009 |
| WO | WO 2009/0289213 | A1 | 11/2009 |
| WO | WO 2010/0151197 | A1 | 6/2010 |
| WO | WO 2010/082710 | A1 | 7/2010 |
| WO | WO 2010/096073 | A1 | 8/2010 |
| WO | WO 2010/129807 | A1 | 11/2010 |
| WO | WO 2011/087458 | A1 | 7/2011 |
| WO | WO 2011/0240130 | A1 | 10/2011 |
| WO | WO 2011/143371 | A1 | 11/2011 |
| WO | WO 2012/024099 | A1 | 2/2012 |
| WO | WO 2012/100099 | A2 | 7/2012 |
| WO | WO 2012/100100 | A2 | 7/2012 |
| WO | WO 2012/0248020 | A1 | 10/2012 |
| WO | WO 2013/022467 | A2 | 2/2013 |
| WO | WO 2013/130118 | A1 | 9/2013 |
| WO | WO 2013/141888 | A1 | 9/2013 |
| WO | WO 2013/141953 | A2 | 9/2013 |
| WO | WO 2015/0306642 | A1 | 10/2015 |

OTHER PUBLICATIONS

International Search Report and Written Opinion for application PCT/US2011/061898 dated Apr. 24, 2013.
International Search Report and Written Opinion for application PCT/US2012/030370 dated Oct. 15, 2012.
International Search Report and Written Opinion for application PCT/US2012/042327 dated May 16, 2013.
International Search Report and Written Opinion for application PCT/US2013/021558 dated Oct. 11, 2013.
International Search Report and Written Opinion for application PCT/US2013/042771 dated May 26, 2014.
International Search Report and Written Opinion for application PCT/US2012/042326 dated Dec. 3, 2012.
International Search Report and Written Opinion for application PCT/US2013/045731 dated Nov. 12, 2013.
International Search Report and Written Opinion for application PCT/US2013/070827 dated Mar. 27, 2014.
International Search Report and Written Opinion for application PCT/US2013/028439 dated Dec. 5, 2013.
International Search Report and Written Opinion for application PCT/US2012/065627 dated Mar. 8, 2013.
International Search Report and Written Opinion for application PCT/US2011/049187 dated Jan. 23, 2013.
International Preliminary Report on Patentability for application PCT/US2011/049187 dated Mar. 7, 2013.
[No Author Listed], Fluorinert Liquids for Electronics Manufacturing. 2003. 3M Corporation. 4 pages.
[No Author Listed]. "Experience," IceBar London, http://www.icebarlondon.com/experience. Last accessed Dec. 7, 2015.
Allain et al., A New Method for Contact-Angle Measurements of Sessile Drops, Journal of Calloid and Interface Science, vol. 107, No. 1, Sep. 1985, 9 pages.
Anand et al., Enhanced Condensation on Lubricant-Impregnated Nanotextured Surfaces. ACS Nano, 6(11):10122-10129 (2012).
Antonini et al., Water Drops Dancing on Ice: How Sublimation Leads to Drop Rebound, PRL 111, 014501 (2013).
Arkles, Hydrophobicity, Hydrophilicity and Silanes, Paint and Coatings Industry, Oct. 1, 2006, 10 pages.
Ashkin et al., Optical levitation by radiation pressure. Applied Physics Letters, 19(8):283-285 (1971).
Ashkin et al., Optical levitation of liquid drops by radiation pressure. Science, 187(4181):1073-1075 (1975).
Avedisian et al., Leidenfrost boiling of methanol droplets on hot porous/ceramic surfaces. International Journal of Heat and Mass Transfer, 30(2):379-393 (1987).
Baier et al., Propulsion Mechanisms for Leidenfrost Solids on Ratchet Surfaces. arXiv preprint arXiv:1208.5721 (2012).
Baier et al., Propulsion mechanisms for Leidenfrost solids on ratchets. Physical Review E—Statistical, Nonlinear, and Soft Matter Physics, 87(2) (2013).
Bargir et al., The use of contact angle measurements to estimate the adhesion propensity of calcium carbonate to solid substrates in water. Applied Surface Science. 2009;255:4873-9.
Barnes, Geoff T., The Potential for Monolayers to Reduce the Evaporation of Water From Large Water Storages, Agricultural Water Management 95, 4:339-353, (2008).
Bauer et al., The insect-trapping rim of Nepenthes pitchers: surface structure and function, Plant Signaling & Behavior, 4 (11 ): 1019-1023 (2009).
Beaugnon et al., Dynamics of magnetically levitated droplets. Physica B: Condensed Matter, 294-295:715-720 (2001).
Betz et al., Do surfaces with mixed hydrophilic and hydrophobic areas enhance pool boiling? Applied Physics Letters. 2010;97:141909-1-3.
Biance et al., Leidenfrost drops. Physics of Fluids, 15(6):1632-1637 (2003).
Bico et al., Pearl drops. Europhysics Letters, 47(2):220-226 (1999).
Bird et al., Reducing the contact time of a bouncing drop. Nature. Nov. 21, 2013;503(7476):385-8. doi: 10.1038/nature12740.
Blossey, R., Self-cleaninq surfaces—Virtual realities. Nature Materials, 2(5):301-306 (2003).
Bohn et al., Insect aquaplaning: Nepenthes pitcher plants capture prey with the peristome, a fully wettable water-lubricated anisotropic surface, Proceedings of the National Academy of Sciences, 14138-14143 (2004).
Burton, et al., Geometry of the Vapor Layer Under a Leidenfrost Drop. Physical Review Letters, 109(7):074301 (2012).
Cao et al., Anti-Icing Superhydrophobic Coatings, Langmuir Letter, 2009, A-E.
Cassie et al., Wettability of porous surfaces, Transactions of the Faraday Society, 40: 546-551, (1944).
Celestin I, et al., Take Off of Small Leidenfrost Droplets. Physical Review Letters, 109(3):034501 (2012).
Chandra et al., Leidenfrost evaporation of liquid nitrogen droplets. Transactions—ASME: Journal of Heat Transfer, 116(4):999-1006 (1994).
Chandra et al., Observations of droplet impingement on a ceramic porous surface. International Journal of Heat and Mass Transfer 35(10):2377-2388 (1992).
Chaudhuri et al., Dynamic contact angles on PTFE surface by aqueous surfactant solution in the absence and presence of electrolytes. J Colloid Interface Sci. Sep. 15, 2009;337(2):555-62. doi: 10.1016/j.jcis.2009.05.033. Epub May 21, 2009.
Chen et al., A Wettability Switchable Surface by Microscale Surface Morphology Change, Journal of Micromechanics & Microengineering, Institute of Physics Publishing, 17(3): 489-195 (2007).
Cummings et al., Oscillations of magnetically levitated aspherical droplets. Journal of Fluid Mechanics, 224:395-416 (1991 ).
Deng et al. Nonwetting of impinging droplets on textured surfaces. Applied Physics Letters, 94(13) (2009).
Elbahri et al., Anti-lotus effect for nanostructuring at the leidenfrost temperature. Advanced Materials, 19(9):1262-1266 (2007).
Feng et al., Design and creation of superwetting/antiwetting surfaces. Advanced Materials, 18(23):3063-3078 (2006).
Fondecave et al., Polymers as Dewetting Agents, Marcomolecules 31 :9305-9315 (1998).
Fujimoto et al., Deformation and rebounding processes of a water droplet impinging on a flat surface above Leidenfrost temperature. Journal of Fluids Engineering, Transactions of the ASME, 118(1):142-149 (1996).
Furmidge, Studies at Phase Interfaces, Journal of Colloid Science, 1962, 17: 309-324.
Gao et al., Artificial lotus leaf prepared using a 1945 patent and a commercial textile. Langmuir, 22(14):5998-6000 (2006).

(56) References Cited

OTHER PUBLICATIONS

Goldshtik et al., A liquid drop on an air cushion as an analogue of Leidenfrost boiling. Journal of Fluid Mechanics, 166:1-20 (1986).
Good, Contact angle, wetting and adhesion: a critical review. J. Adhesion Sci. Technol. 1992;6(12):1269-302.
Grace, Energy from Gas Hydrates: Assessing the Opportunities and Challenges for Canada. Council of Canadian Academies. Jul. 2008. 8 pages.
Gradeck et al., Heat transfer for Leidenfrost drops bouncing onto a hot surface. Experimental Thermal and Fluid Science, 47:14-25 (2013).
Hashmi et al., Leidenfrost levitation: Beyond droplets. Scientific Reports, 2:797:1-4 (2012).
Hejazi et al., Wetting Transitions in Two-, Three-, and Four-Phase Systems, Langmuir, 28:2173-2180 (2012).
Holden et al., The Use of Organic Coatings to Promote Dropwise Condensation of Steam, Journal of Heat Transfer, 109: 768-774 (1987).
Iwasa, et al., 'Electromaglev'—Magnetic levitation of a superconducting disc with a DC field generated by electromagnets: Part 1. Theoretical and experimental results on operating modes, lift-to-weight ratio, and suspension stiffness. Cryogenics, 37(12):807-816, (1997).
Jung et al., Are superhydrophobic surfaces best for icephobicity? Langmuir, 27(6):3059-3066 (2011).
Kazi et al., Mineral Scale Formation and Mitigation on Metals and a Polymeric Heat Exchanger Surface. Applied Thermal Engineering. 2010;30:2236-42.
Kim et al., Hierarchical or not? Effect of the length scale and hierarchy of the surface roughness on omniphobicity of lubricant-infused substrates. Nano Letters, 13(4):1793-1799 (2013).
Kim et al., Levitation Time Measurement of Water Drops on the Surface of Liquid Nitrogen, Journal of the Korean Physical Society, vol. 58, No. 6, pp. 1628-1632 (Jun. 2011 ).
Kim, Heetae, Floating Phenomenon of a Water Drop on the Surface of Liquid Nitrogen, Journal of the Korean Physical Society, vol. 49, No. 4, pp. L 1335-L 1338 (Oct. 2006).
Kulinich et al., Ice Adhesion on Super-Hydrophobic Surfaces, Applied Surface Science, 2009, 225: 8153-8157.
Lafuma A. et al., Slippery pre-suffused surfaces, Europhysics Letters: vol. 96, 56001, pp. P1-P4, Nov. 3, 2011.
Lagubeau et al., Leidenfrost on a ratchet. Nature Physics, 7(5):395-398 (2011 ).
Lee et al., Dynamic Wetting and Spreading Characteristics of a Liquid Droplet Impinging on Hydrophobic Textured Surfaces, Langmuir, (2011 ), 27, 6565-6573.
Leidenfrost, On the fixation of water in diverse fire. International Journal of Heat and Mass Transfer, 9(11 ):1153-1166 (1966).
Li et al., Dynamic Behavior of the Water Droplet Impact on a Textured Hydrophobic/Superhydrophobic Surface: The Effect of the Remaining Liquid Film Arising on the Pillars' Tops on the Contact Time, Langmuir, (2010), 26(7), 4831-4838.
Linke et al., Self-propelled leidenfrost droplets. Physical Review Letters, 96(15) (2006).
Liu et al., Metallic Surfaces with Special Wettability, Nanoscale, 3:825-238 (2011 ).
Marin et al., Capillary droplets on Leidenfrost micro-ratchets. arXiv preprint arXiv:1210.4978 (2012).
Meuler et al., Exploiting Topographical Texture to Impact Icephobicity, ACS Nano, 2010, 4(12): 7048-7052.
Mills, A. A., Pillow lavas and the Leidenfrost effect. Journal of the Geological Society, 141(1):183-186 (1984).
Mishchenko et al., Design of ice-free nanostructured surfaces based on repulsion of impacting water droplets. ACS Nano, 4(12):7699-7707 (2010).
Onda et al., Super-water-repellent fractal surfaces. Lanamuir, 12(9) (1996).
Ou et al., Laminar drag reduction in microchannels using ultrahydrophobic surfaces. Physics of Fluids, 16(12):4635-4643 (2004).
Park et al., A Numerical Study of the Effects of Superhydrophobic Surface on Skin-Friction Drag in Turbulent Channel Flow, Phys. Fluids 25, 110815 (2013).
Piro I RD et al., Magnetic control of Leidenfrost drops. Physical Review E - Statistical, Nonlinear, and Soft Matter Physics, 85(5) (2012).
Pozzato et al., Superhydrophobic surfaces fabricated by nanoimprint lithography, Microelectronic Engineering, 83, (2006), 884-888.
Prat et al., On the effect of surface roughness on the vapor flow under Leidenfrost-Levitated droplets. Journal of Fluids Enaineerina, Transactions of the ASME, 117(3):519-525 (1995).
Quere et al., Surfing the hot spot. Nature Materials, 5(6):429-430 (2006).
Quere, D., Leidenfrost dynamics, Annu. Rev. Fluid Mech., 197-215 (2013).
Quere, D., Non-sticking drops, Institute of Physics Publishing, Rep.Prag.Phys., 68(11 ):2495-2532 (2005).
Rausch et al., On the Characteristics of Ion Implanted Metallic Surfaces Inducing Dropwise Condensation of Steam, Lanamuir, 26(8): 5971-5975 (2010).
Reyssat et al., Dynamical superhydrophobicity. Faraday Discussions, 146:19-33 (2010).
Reyssat, et al., Bouncing transitions on microtextured materials. Europhysics Letters, 74(2):306-312 (2006).
Richard, D. et al., Contact time of a bouncing drop, Nature 417:(6891 ):811 (2002).
Roosen et al., Optical levitation by means of two horizontal laser beams: a theoretical and experimental study. Physics Letters A, 59(1):6-8 (1976).
Rothstein, J. P., Slip on superhydrophobic surfaces, ANRV400-FL42-05, ARI, 89-109 (2010).
Rykaczewski et al., Mechanism of Frost Formation of Lubricant-Impregnated Surfaces, Langmuir 2013, 29 5230-5238, 13 pages.
Santos et al., Modified Stainless Steel Surfaces Targeted to Reduce Fouling. J. Food Engineering. 2004;64:63-79.
Seiwert et al., Coatina of a Textured Solid, J. Fluid Mech., 2011, 669: 55-63.
Sekeroglu et al., Transport of a soft cargo on a nanoscale ratchet. Applied Physics Letters, 99(6) (2011 ).
Sloan, Jr., Fundamental Principles and Applications of Natural Gas Hydrates. Nature Publishing Group. 2003:353-9.
Smith et al., Droplet Mobility on Lubricant-Impregnated Surfaces, Soft Matter, 2012(9): 1772-1780 (2012).
Smith, Liquid-encapsulating surfaces: overcoming the limitations of superhydrophobic surfaces for robust non-wetting and anti-icing surfaces. Bulleting of the American Physical Society. 2011. Abstract Only.
Snoeijer et al., Maximum size of drops levitated by an air cushion. Physical Review E—Statistical, Nonlinear, and Soft Matter Physics, 79(3) (2009).
Song et al., Superhydrophobic Surfaces Produced by Applying a Self-Assembled Monolayer to Silicon Micro/Nano-Textured Surfaces, Nano Research, 2009, 2: 143-150.
Song et al., Vitrification and levitation of a liquid droplet on liquid nitrogen, PNAS Early Edition, pp. 1-5 (201 O).
Sum et al., Clathrate Hydrates: From Laboratory Science to Engineering Practice. American Chemical Society Ind. Eng. Chem. Res. Jul. 22, 2009;48(16):7457-65.
Trinh et al., The dynamics of ultrasonically levitated drops in an electric field. Physics of Fluids, 8(1):43-61 (1996).
Tropmann et al., Completely superhydrophobic PDMS surfaces for microfluidics. Langmuir. Jun. 5, 2012;28(22):8292-5. doi: 10.1021/la301283m. Epub May 21, 2012.
Tuteja et al., Desiqninq superoleophobic surfaces. Science, 318(5856):1618-1622 (2007).
Tuteja et al., Robust omniphobic surfaces. Proceedings of the National Academy of Sciences of the United States of America, 105(47):18200-18205 (2008).
Vakarelski et al., Drag reduction by leidenfrost vapor layers. Physical Review Letters, 106(21) (2011).
Vakarelski et al., Stabilization of Leidenfrost vapour layer by textured superhydrophobic surfaces. Nature, 489(7415):274-277 (2012).

(56) References Cited

OTHER PUBLICATIONS

Varanasi et al., Frost formation and ice adhesion on superhydrophobic surfaces. Applied Physics Letters, 97(23) (2010).
Varanasi et al., Spatial Control in the Heterogeneous Nucleation of Water, Applied Physics Letters, 95: 094101-01-03 (2009).
Weber et al., Aero-acoustic levitation: A method for containerless liquid-phase processing at high temperatures. Review of Scientific Instruments, 65(2):456-465 (1994).
Weickgenannt et al., lnverse-Leidenfrost phenomenon on nanofiber mats on hot surfaces. Physical Review E—Statistical, Nonlinear, and Soft Matter Physics, 84(3) (2011).
Weilert et al., Magnetic levitation and noncoalescence of liquid helium. Physical Review Letters, 77(23):4840-4843 (1996).
Welter et al., Acoustically levitated droplets—A new tool for micro and trace analysis. Fresenius' Journal of Analytical Chemistry, 357(3):345-350 (1997).
Wenzel, Resistance of Solid Surfaces to Wetting by Water, Industrial & Engineering Chemistry, 28(8): 988-994 (1936).
Wong, Tak-Sing et al., Bioinspired self-repairing slippery surfaces with pressure-stable omniphobicity, Nature, vol. 477, No. 7365, pp. 443-447, Sep. 22, 2011.
Wurger, A., Leidenfrost gas ratchets driven by thermal creep. Physical Review Letters, 107(16) (2011).
Yarin et al., On the acoustic levitation of droplets. Journal of Fluid Mechanics, 356:65-91 (1998).
Yasuda et al., Levitation of metallic melt by using the simultaneous imposition of the alternating and the static magnetic fields. Journal of Crystal Growth, 260(3-4):475-485 (2004).
Yu et al., Containerless solidification of oxide material using an electrostatic levitation furnace in microqravity. Journal of Crystal Growth, 231 (4):568-576 (2001).
Zhao et al., Dropwise condensation of Steam on Ion Implanted Condenser Surfaces, Heat Recovery Systems & CHP, 14(5): 525-534 (1994).

* cited by examiner

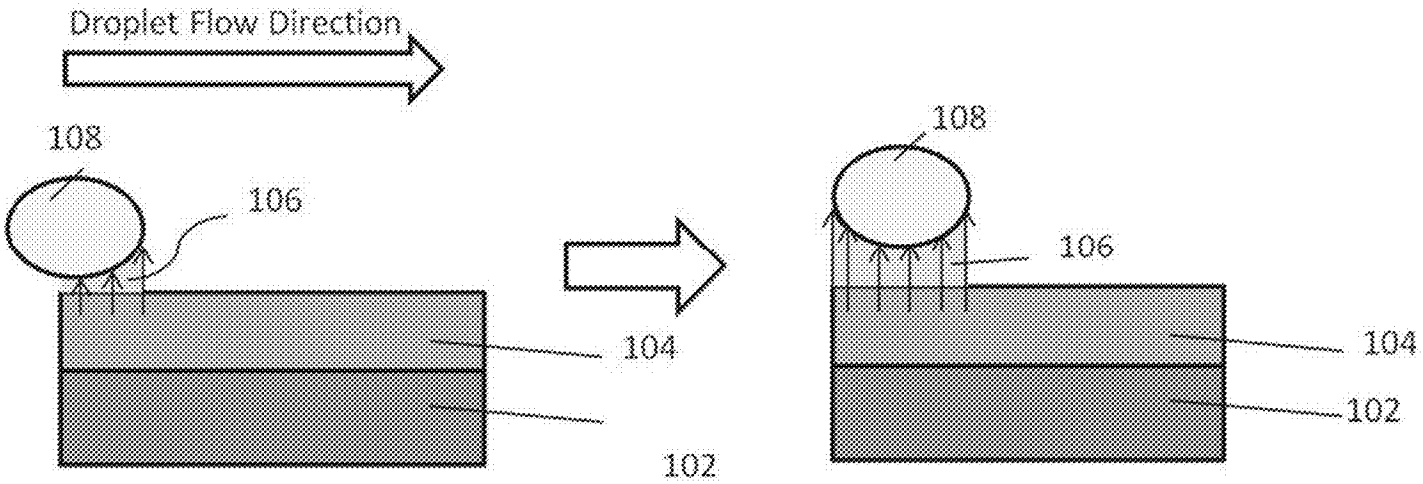
FIG. 1(e)
FIG. 1(f)
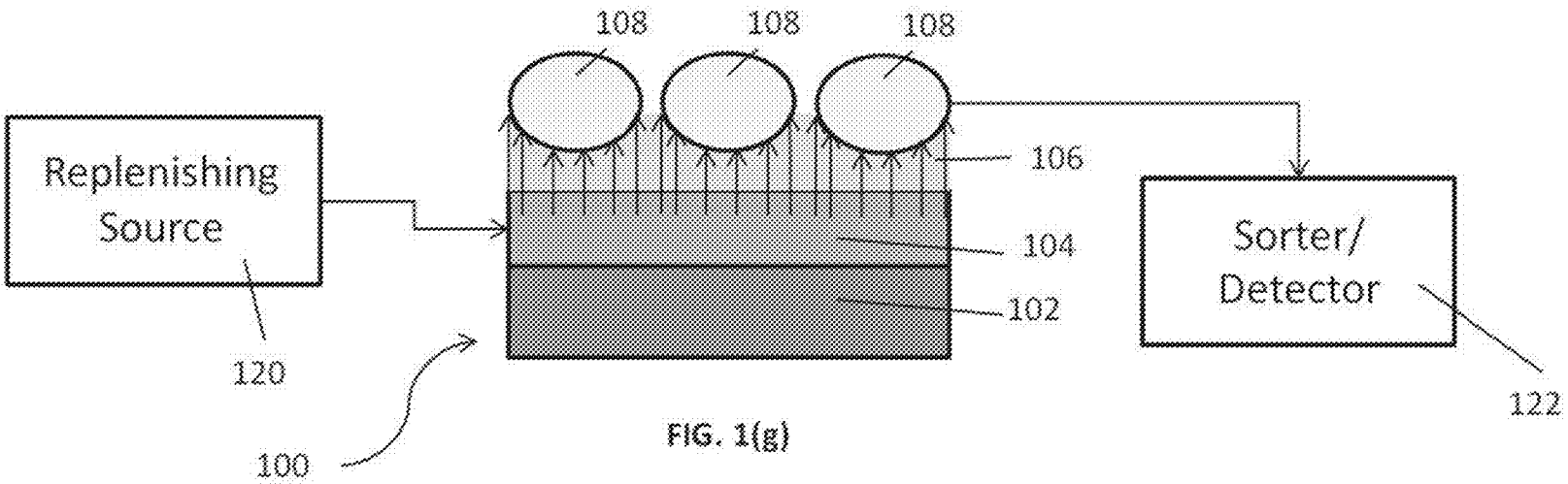
FIG. 1(g)

Liquid
Gas
Solid

Liquid
Solid

Intermediate Layer
Suspended Material (Material 2)
Solid
Secondary Material (Material 1)

ARTICLES AND METHODS FOR LEVITATING LIQUIDS ON SURFACES, AND DEVICES INCORPORATING THE SAME

RELATED APPLICATION

This application is a continuation of U.S. application Ser. No. 15/417,094, filed Jan. 26, 2017, entitled "ARTICLES AND METHODS FOR LEVITATING LIQUIDS ON SURFACES, AND DEVICES INCORPORATING THE SAME", which is a continuation of U.S. application Ser. No. 13/917,585, filed Jun. 13, 2013, which claims priority under 35 U.S.C. 119(e) to U.S. Provisional Patent Application Ser. No. 61/659,400, filed Jun. 13, 2012, each of which is incorporated by reference here in its entirety.

STATEMENT REGARDING FEDERALLY SPONSORED RESEARCH OR DEVELOPMENT

This invention was made with Government support under Grant No. CBET0952564 awarded by the National Science Foundation (NSF). The Government has certain rights in the invention.

TECHNICAL FIELD

This invention relates generally to articles, devices, and methods for reducing or eliminating drag and diminishing adhesion between a liquid or solid substance flowing over a solid or liquid surface.

BACKGROUND

There is a need for articles and methods for facilitating the flow of substances (both liquids and solids) over both solid and liquid surfaces. Certain previous methods employ coated and/or textured surfaces that, by virtue of contact between the surface and the flowing liquid, always have a certain degree of adhesion with the liquid.

Overcoming adhesion between materials is key for solving many industrial problems such as decreasing pumping requirements for liquids in pipes, shedding droplets, decreasing ice adhesion, and many others. For some situations, the contact between a liquid and a solid surface is undesirable, because such contact may bring contaminants from the solid surface into the liquid. Hence, there is a need to develop mechanisms that can decrease adhesion of flowing substances on the surfaces over which the flowing substances flow, or eliminate the contact between the flowing substances and the surfaces over which they flow altogether. With respect to the latter, the following methods have been employed: (1) textured surfaces; (2) levitation through Leidenfrost effect; and (3) other means such as air cushion, acoustic levitation, optical levitation, magnetic levitation, and electrodynamic/static levitation methods.

In the textured surfaces method, the use of micro/nano-engineered surfaces has been applied to a large variety of physical phenomena in thermofluids sciences, such as, liquid-solid drag, ice adhesion, self-cleaning, and water repellency. The enhancement results from diminished contact between the solid surface and interacting liquid (water) due to a combination of physical and chemical attributes imparted to the surface. For example, by creating micro/nano-scale roughness along with depositing a hydrophobic coating, surfaces can be made superhydrophobic that show resistance to contact with water by virtue of a stable air-water interface in surface textures (see FIG. 2(*a*)). As long as this interface is maintained, the surface exhibits enhanced qualities; for example, reduced drag of water flowing over the surface, and enhanced impinging water droplet repellency. However, the air-water interface may be easily impaled (see FIG. 2(*b*)) due to the dynamic pressure of liquid and consequently, the surface loses the above qualities. To prevent impalement, the state-of-the-art focuses on reducing texture dimensions by, for example, using nano-scale features. However, such surfaces are difficult to fabricate and are impractical for large-scale industrial applications. Further, the low adhesion of most textured surfaces is limited to a few liquids, such as water, which have high surface tension and low viscosities. Making surfaces that are omniphobic and repel a variety of liquids requires further consideration into texture design. Textured surfaces impregnated with a liquid lubricant immiscible to the liquid to be shed has been promoted as an alternative method to decrease the adhesion of liquids on such surfaces. However, despite low adhesion, the contact area between droplets and the solid surface may be high due to interfacial tension between the two liquids, and droplets on such surfaces have low contact angles, resulting in a high contact base area between the droplets and the underlying surface and increased drag.

In the levitation through Leidenfrost effect method, levitation of droplets is achieved by heating a solid surface to temperatures much higher than the boiling point of the liquid droplet (typically, >70° C.) such that the droplets levitate on the surface by virtue of a 'vapor cushion' that is generated through the evaporation of the superheated droplet itself. This is known as the Leidenfrost effect. The levitated droplets can freely move along the surface with almost negligible contact with the underlying solid surface. The Leidenfrost effect has been demonstrated with respect to water, organic liquids of low viscosity, liquid nitrogen, liquid oxygen, and dry ice. However, the method has several limitations. Generation of a vapor cushion requires evaporation of the suspended material and results in a loss of the suspended material. Secondly, the process requires the surface temperature to be much higher than the boiling point of the material to be suspended. This necessitates a large expenditure of energy and also requires the process to be carried out at higher temperature. Many liquids and their vapors are combustible in nature, and the excess heating may produce conditions that are hazardous in a working environment. Thirdly, directed and controlled motion requires special texturing on the substrates. Fourth, because the process is initiated at high temperatures, this changes the physical properties of the suspended liquid, which may be undesirable. Fifth, many liquids that are highly viscous in nature may not be suspended by this technique. Sixth, directing the motion of the suspended liquid requires that the entire surface be heated to a temperature higher than the Leidenfrost Point (the temperature at which Leidenfrost Effect is initiated on a surface). Seventh, there is a limit to the size of the 'cargo' (liquid droplets or solid substrates) that can be levitated without the undesirable effects such as boiling or bubble formation on the surface. The method presented in this work overcomes these limitations in certain embodiments.

Other methods for liquid levitation have also been proposed such as air cushion, acoustic levitation methods, optical levitation, and magnetic or electrodynamic/static levitation. However, each of these methods has its own associated limitations. Suspending liquid droplets via pumping air below them requires formation of small holes regularly spaced over the surface, which then necessitates high powered pumps because of large pressure drop within the minichannels of such perforated solids. Optical, magnetic, and electrostatic/dynamic methods require high power consumption for levitation for generating the required acoustic, magnetic, or electric fields. Further, levitation of droplets using magnetic fields or electric fields requires special types of liquids to be used that have properties that are affected by the above mentioned forces.

SUMMARY OF THE INVENTION

Described herein, in certain embodiments, are methods for reducing or eliminating drag and adhesion of a substance flowing over a surface by creating a cushion of vapor via evaporation of a phase-changing material of (or on) the surface or encapsulated within textures of the surface. The vapor layer causes the flowing substance to be suspended over the surface, greatly reducing friction, drag, and adhesion between the flowing substance and the surface. The substance may be in the form of a liquid, a solid, a droplet, or a stream of droplets. The surface may include a solid phase-changing material, a liquid phase-changing material, or any combination of solid and liquid phase-changing materials. According to certain embodiments, the surface is composed entirely of phase-changing material or materials (solid, liquid, or a combination of solid and liquid phase-changing materials). The surface may be positioned over or coated onto a solid substrate.

The temperature of the flowing substance is above the sublimation point and/or melting temperature of at least one phase-changing material that is part of the surface. The phase-changing material undergoes a phase change (evaporation or sublimation) upon contact with the flowing substance due to local heat transfer from the flowing substance to the material, generating a vapor cushion between the solid or liquid material and the flowing substance. According to certain embodiments, only a portion of the phase-changing material that is in contact with the flowing substance (e.g., the portion that is immediately underneath the flowing substance) undergoes the phase change. It is contemplated that only an upper portion (e.g., the portion in contact with the flowing substance) of the phase-changing material vaporizes, whereas a lower portion of the phase-changing material remains in its original (e.g., solid or liquid) state. Furthermore, according to certain embodiments, the portion of the phase-changing material that is not in contact with the flowing substance does not undergo the phase change. The present approach may be employed in a wide variety of temperatures and does not require boiling.

In some embodiments, articles, apparatus, methods, and processes described herein can be used for levitation of small sized and/or lightweight solid substances when enough vapor is generated to suspend them. Articles, methods, and processes described herein yield surfaces that can levitate drops of any material on a surface including a phase-changing material as long as levitation is achieved through vaporization of the phase-changing material having suitable thermal properties (e.g., vaporization of a phase-changing material having a sublimation and/or melting point that is lower than the temperature of the material to be levitated).

A flowing substance can be suspended even at room temperatures by using a surface encapsulated, covered, or including a phase-changing material that has high vapor pressure at room temperatures. Further, the levitating effect can be obtained at low temperatures (e.g., lower than room temperature) as well by choosing an appropriate phase-changing material that can vaporize at that temperature. In addition, this approach is easily customizable to suit a particular application by simply selecting a suitable phase-changing material with high vapor pressure for any given thermodynamic environmental conditions.

The methods and articles described herein may be used in all applications that are affected by contact between materials, including manipulating droplets to move across a solid or a liquid surface with minimum force; limiting the contact of hazardous or sensitive materials with an external surface; moving highly viscous oils through long oil pipelines; shedding of impinging liquids, as well as other suitable applications. Moreover, the present approach does not require special features to be built on a solid substrate and can be implemented on all solid substrates compatible with the surface, as well as on microtextured solid substrates to maintain enhanced qualities without requiring nano-scale textures as required in existing approaches. This is advantageous as fabricating micro-scale features is much easier and cheaper than nano-scale ones, making the present approach more practical.

Furthermore, in certain embodiments, the surface may include channels or microchannels positioned therein to direct the flowing substance to flow above these channels or microchannels. Aspects of the present invention relate to achieving specific directional motion of the flowing substance, if desired.

Moreover, in certain embodiments, the contact between the flowing substance and the surface is minimized, leading to very low hysteresis (<2°).

One embodiment of the present invention relates to a method of facilitating flow of a flowing substance on a surface including a phase-changing material. The method includes providing a surface comprising the phase-changing material having a melting temperature and/or sublimation temperature (at operating pressure) lower than the flowing substance temperature. The method also includes introducing the flowing substance onto the surface. The introduction of the flowing substance on the surface causes at least a portion of the phase-changing material to locally transition from a first state to a second state, thereby forming a lubricating intermediate layer between the flowing substance and the surface.

In certain embodiments, the surface is impregnated with the phase-changing material, and the surface includes a matrix of features spaced sufficiently close to stably contain the phase-changing material therebetween or therewithin. In certain embodiments, the surface is microtextured.

In certain embodiments, the flowing substance is a droplet. In certain embodiments the method also includes the step of encapsulating biological matter into the droplet. In certain embodiments, the biological matter includes DNA and/or RNA. In certain embodiments, the droplet has a volume in a range from between 0.1 pL to 1000 pL.

In certain embodiments, the flowing substance is a solid at operating conditions. In certain embodiments, the flowing substance is a liquid at operating conditions. In certain embodiments, the flowing substance is a stream of liquid. In certain embodiments, the flowing substance is a stream of droplets.

In certain embodiments, the surface is a coating on a substrate. In certain embodiments, a surrounding gas (e.g., air) has a temperature that is lower than the melting temperature and/or sublimation temperature of the phase-changing material, so that the phase-changing material substantially remains in the first state in locations other than locations in contact with the flowing substance. In certain embodiments, the surface forms a channel over which (or through which) the flowing substance flows. In certain embodiments, the surface includes at least one phase-changing material positioned in a selected pattern, and the flowing substance flows over the surface according to the selected pattern. In certain embodiments. The pattern is a substantially V-shaped pattern, the method further including introducing a second flowing substance onto the surface, wherein the flowing substance and the second flowing substance flow along different branches of the substantially V-shaped pattern, the flowing substance and the second flowing substance merging at an apex of the substantially V-shaped pattern.

In certain embodiments, the method also includes the step of replenishing a supply or level of the phase-changing material. In certain embodiments, the phase-changing material is a liquid or a solid in the first state and a vapor in the second state. In certain embodiments, the phase-changing material is a liquid selected from kerosene, dichloromethane, acetone, ethanol, iodine, and naphthalene. In certain embodiments, the phase-changing material is dry ice. In certain embodiments. The phase-changing material is a solid selected from camphor and dry nitrogen.

In certain embodiments, a volume of the flowing substance remains constant during transport. In certain embodiments, the phase-changing material is unreactive and immiscible with the flowing substance. In certain embodiments, the flowing substance is in contact only with the phase-changing material in the second state during transport.

In certain embodiments, the flowing substance has a melting and/or sublimation point that is higher than the melting and/or sublimation point of the phase-changing material.

Elements of embodiments described with respect to a given aspect of the invention may be used in various embodiments of another aspect of the invention. For example, it is contemplated that features of dependent claims depending from one independent claim can be used in apparatus and/or methods of any of the other independent claims.

BRIEF DESCRIPTION OF THE DRAWINGS

The objects and features of the invention can be better understood with reference to the drawings described below, and the claims.

FIGS. 1(*a*) and 1(*b*) correspond to states of complete levitation of Material 2. FIGS. 1(*c*) and 1(*d*) correspond to states of partial or intermittent levitation of Material 2. In FIGS. 1(*b*) and 1(*d*), the Material 2 has a temperature that is higher than the phase transformation point (melting point and/or the sublimation point) of Material 1 and the phase change temperature of Material 2 is higher than the phase change temperature of Material 1.

FIG. 1(*e*) is a schematic view of a solid substrate 102 at least partially covered by a surface 104, the surface includes at least one phase-changing material, at least a portion of which transitions from its first original state to a second state upon contact with a droplet 108. Layer 106 is a lubricating intermediate layer between the droplet 108 and the surface 104.

FIG. 1(*f*) is a schematic view of the droplet 108 of FIG. 1(*e*) after the droplet 108 has moved further in the shown flow direction. The intermediate layer 106 forms underneath the entire droplet 108.

FIG. 1(*g*) is a schematic view of a stream of droplets 108 flowing over the surface 104. The conditions of operation may be selected such that the lubricating intermediate layer 106 is maintained between the stream of droplets 108 and the surface 104. In other words, the operating conditions may be selected such that there is a constant lubricating intermediate layer 106 between the stream of droplets 108 and the surface 104. The phase-changing material or materials within the surface 104 may be coupled to a replenishing source 120 that is configured to replenish an amount of the phase-changing material or materials within the surface 104 that is/are configured to transition to the second state. The surface 104 may include one or more sensors configured to transmit a signal to the replenishing source 120 to replenish an amount of the phase-changing material or materials within the surface 104 if an amount of the phase-changing material or materials within the surface 104 falls below a predetermined threshold. Each droplet 108 may be directed to a sorter/detector 122 that is configured to identify and sort the droplets 108. Although FIGS. 1(*e*) through 1(*g*) are shown and described with regards to droplets 108, those of ordinary skill in the art would appreciate that the droplet 108 could be any solid, liquid, or a stream of solids or liquids that is flowing over the surface 104.

FIG. 2(*b*) is a schematic of liquid state on a typical hydrophobic surface in a state when the texture has impaled the liquid.

FIG. 2(*c*) is a schematic of a flowing substance (suspended material (Material 2) being levitated or suspended through vaporization of an encapsulating substance (secondary material (Material 1)) within the surface textures of a solid substrate (solid) to eliminate contact between the flowing substance (suspended material (Material 2)) and the solid substrate (solid). Vaporization of the encapsulating substance (secondary material (Material 1)) results in formation of the intermediate lubricating vapor layer. In this embodiment, the flowing substance (suspended material) is shown in complete levitation mode. The flowing substance (suspended material) may remain in partial or intermittent levitation mode as well.

FIG. 9(*b*) illustrates a tube made of an underlying surface material.

FIG. 9(*c*) illustrates an arbitrarily shaped channel patterned in an underlying surface material.

DESCRIPTION

Figure 1A:
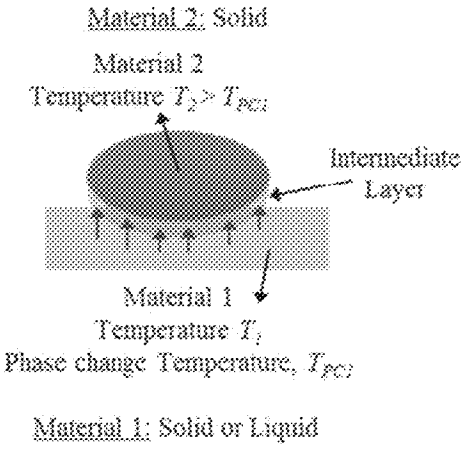
FIGS. 1(*a*)-(*d*) illustrate is a schematic view of an Intermediate Layer (vapor) being generated between Material 1 and Material 2. The Material 2 has a temperature that is higher than the phase transformation point (melting point and/or the sublimation point) of Material 1. The contact between Material 2 and Material 1 causes a portion of the Material 1 that is in contact with Material 2 to transition to the Intermediate Layer state, which is a vapor state.
Figure 1B:
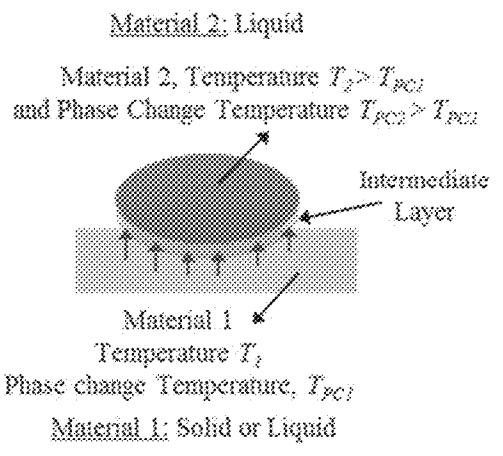
Figure 1C:
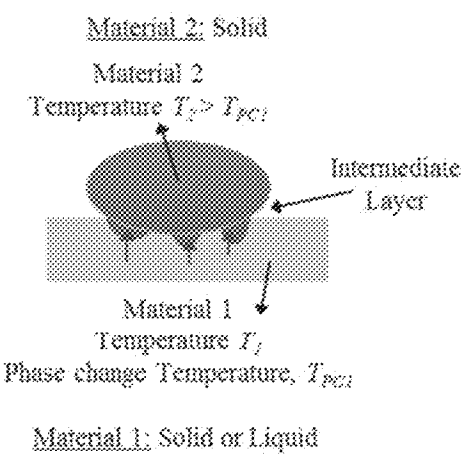
Figure 1D:
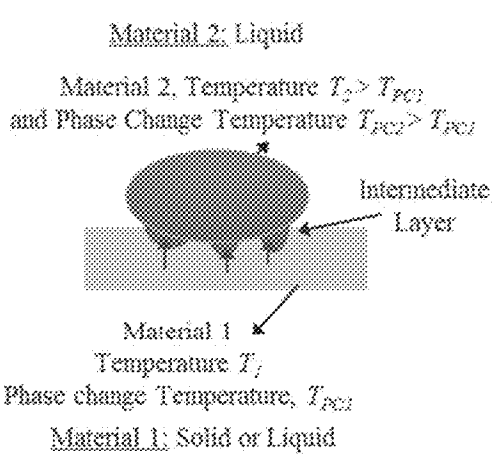

It is contemplated that apparatus, articles, methods, and processes of the claimed invention encompass variations and adaptations developed using information from the embodiments described herein. Adaptation and/or modification of the apparatus, articles, methods, and processes described herein may be performed by those of ordinary skill in the relevant art.

Throughout the description, where apparatus and articles are described as having, including, or comprising specific components, or where processes and methods are described as having, including, or comprising specific steps, it is contemplated that, additionally, there are apparatus and articles of the present invention that consist essentially of, or consist of, the recited components, and that there are processes and methods according to the present invention that consist essentially of, or consist of, the recited processing steps.

It should be understood that the order of steps or order for performing certain actions is immaterial so long as the invention remains operable. Moreover, two or more steps or actions may be conducted simultaneously.

The mention herein of any publication, for example, in the Background section, is not an admission that the publication serves as prior art with respect to any of the claims presented herein. The Background section is presented for purposes of clarity and is not meant as a description of prior art with respect to any claim.

In certain embodiments, micro-scale features are used (e.g., from 1 micron to about 100 microns in characteristic dimension). In certain embodiments, nano-scale features are used (e.g., less than 1 micron, e.g., 1 nm to 1 micron).

Certain embodiments of the present invention relate to lowering the adhesion between two materials by creating an lubricating intermediate layer generated by a phase change (evaporation/sublimation) of at least one phase-changing material of or on the underlying surface as shown in FIGS. 1 and 1(*e*)-1(*g*). According to one embodiment, the intermediate layer includes a vapor layer formed by either evaporation of at least one phase-changing material (Material 1) from the underlying surface where the Material 1 is a liquid, or by sublimation of the at least one material (Material 1) from the underlying surface where the Material 1 is a solid. The underlying surface may include one or more phase-changing materials that exhibit different thermal properties.

In one embodiment, the formation of the intermediate lubricating vapor layer may result in complete levitation of the flowing substance (suspended material), thus resulting in no contact between the flowing substance (suspended material) and the underlying surface (FIGS. 1(*a*) and 1(*b*)). In another embodiment, the formation of the intermediate lubricating vapor layer may result in partial levitation that results in decreased contact between the flowing substance (suspended material) and the underlying surface (FIGS. 1(*c*) and 1(*d*)). In yet another embodiment, the flowing substance (suspended material) may intermittently contact the underlying surface material (FIGS. 1(*c*) and 1(*d*)).

Here, "complete levitation" is defined as the state where the flowing substance (suspended material) is separated by the intermediate lubricating vapor layer at all times during transport of the flowing substance (suspended material), "Partial levitation" is defined as the state where the flowing substance (suspended material) is in partial contact with the intermediate lubricating vapor layer at all times during transport of the flowing substance (suspended material). "Intermittent levitation" exists when the flowing substance (suspended material) exists in either "partial levitation" or "complete levitation" at different times during the transport of the flowing substance (suspended material).

Whether the levitation is complete, partial, or intermittent may depend upon several factors including, but not limited to, a weight of the flowing substance (suspended material), the vaporization rate of the phase-changing material, the thermal properties of the flowing substance (suspended material), instabilities in the system and flow conditions of the flowing substance (suspended material). The flowing substance (e.g., a water droplet or film) can move on such intermediate lubricating vapor layer with negligible adhesion. In certain embodiments, partial or intermittent levitation of a wide variety of flowing substances is possible, which leads to very low adhesion of the flowing substance to the underlying surface.

Figures 2A, 2B, 2C:
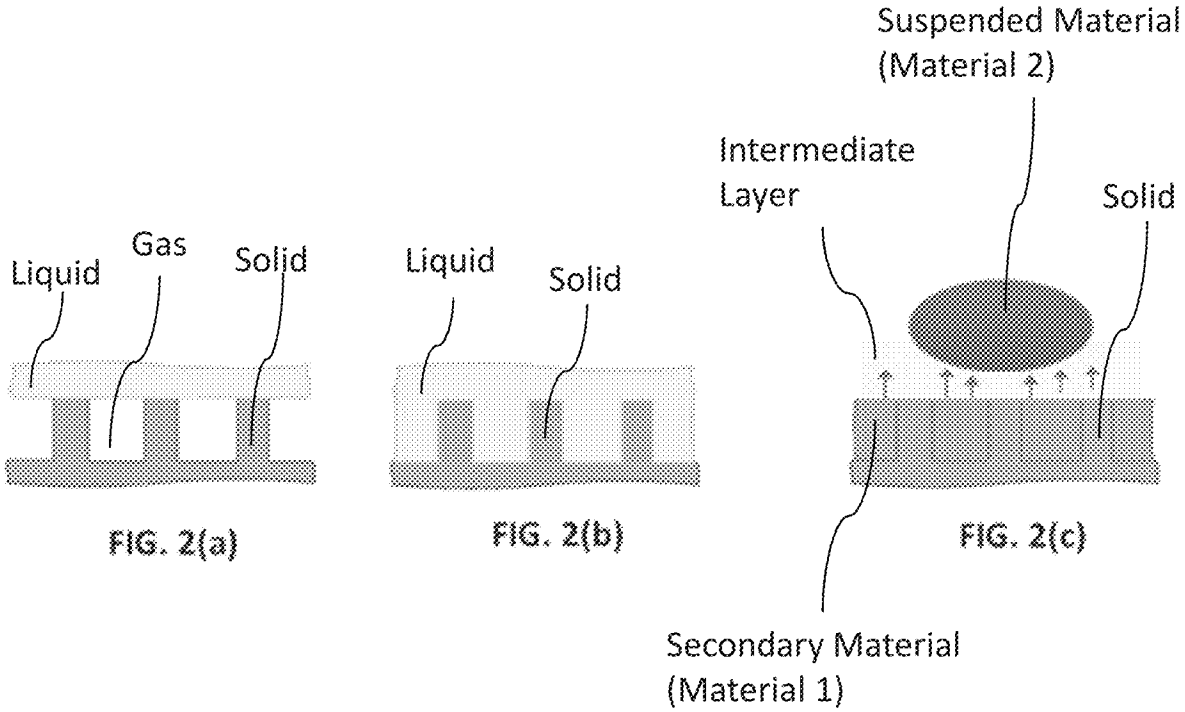
FIG. 2(*a*) is a schematic of liquid state on a typical hydrophobic surface in a state where the surface texture has not yet impaled the liquid.

According to another embodiment of the present invention, the phase-changing material may be entrapped in a solid surface by means of impregnation as illustrated in FIG. 2(*c*). Liquid impregnated surfaces are described in U.S. patent application Ser. No. 13/302,356, entitled "Liquid-Impregnated Surfaces, Methods of Making, and Devices Incorporating the Same," filed Nov. 22, 2011, the disclosure of which is hereby incorporated by reference herein in its entirety. Articles and methods that enhance or inhibit droplet shedding from surfaces are described in U.S. patent application Ser. No. 13/495,931, entitled, "Articles and Methods for Modifying Condensation on Surfaces," filed Jun. 13, 2012, the disclosure of which is incorporated by reference herein in its entirety.

According to certain aspects of the present invention, a solid substrate (e.g., pipeline) is covered at least in part by a solid or liquid surface. The solid or liquid surface may be poured, coated, laminated, or applied in any suitable way to the solid substrate. The solid or liquid surface includes or is composed of at least one phase-changing material that is configured to evaporate or sublimate upon contact with a flowing substance (solid or liquid) and to form a vapor layer between the flowing substance and the solid or liquid surface. In certain embodiments, a solid surface envelops the phase-changing material, such that the entire portion of the solid surface in contact with the flowing substance is covered with the phase-changing material.

A large class of solid and liquid phase-changing materials exist that can vaporize at different temperatures; thus, the low adhesion through vapor cushion can be obtained at temperatures that are significantly below the Leidenfrost temperature of water. Thus, aspects of the present invention do not require expanding significant energy to heat the underlying solid or liquid surface to the Leidenfrost temperature of water to suspend water droplets over a surface. A flowing substance may be suspended even at room temperatures by using a surface that includes a phase-changing material having a high vapor pressure at room temperatures. Moreover, the suspension of a flowing substance may be achieved at low temperatures (e.g., below or significantly below room temperature) by selecting an appropriate solid or liquid phase-changing material of or on the surface or encapsulated within textures of the surface that can vaporize at such low temperatures.

Furthermore, in contrast with the Leidenfrost phenomenon, which results in the loss (via evaporation) of the flowing substance (water), aspects of the present invention relate to articles and methods that result in no loss or only negligible loss of the flowing substance. Only the phase-changing material that evaporates or sublimates is dissipated when the flowing substance flows over the surface. The volume and amount of the flowing substance remains constant during transport. Furthermore, the flowing substance remains intact during transport; moreover, aspects of the present invention relate to reducing and preventing contamination of the flowing substance by cutting off or preventing oxygen, dust particles, and other contaminants from reaching the flowing substance. Certain embodiments relate to creating the intermediate lubricating vapor layer that may envelop the flowing substance, thus preventing contaminants and other particles from reaching the flowing substance.

Contact Regimes of Suspended Flowing Substance and the Substrate Material

The contact area between the flowing substance (solid or liquid) and the underlying surface including the phase-changing material(s) is determined by the thickness and uniformity of the intermediate layer that is generated by the phase-changing material(s) on or of the underlying surface. The intermediate layer thickness is determined by the evaporation/sublimation rate of the phase-changing material(s). As discussed above, three states of levitation are possible—complete, partial, and intermittent levitation.

Complete levitation is the state where the flowing substance is separated by the intermediate layer at all the times, thus resulting in no contact between the flowing substance and the underlying surface (e.g., FIGS. 1(*a*) and 1(*b*)). For a flowing substance of density $\rho_d$, and radius $R_d$, the body forces are given by $\rho_d R_d^3 g$. For complete levitation, the evaporation rate needs to be sufficient to counter this body force. If the phase-changing material is evaporating/sublimating at a rate of $\dot{m}_v$ kg/s, and generates a vapor velocity of $U_v$ m/s, then for complete levitation:

$$\begin{aligned} &\rho_d R_d^3 g \sim \dot{m}_v U_v \\ &\sim \rho_v R_d^2 U_v \\ &\rightarrow U_v \sim \frac{\rho_d g}{\rho_v} R_d \end{aligned} \tag{1}$$

Thus, if the phase-changing material generates vapor with flow given by Equation (1), a flowing substance may be completely suspended on the generated vapor cushion.

Partial levitation is the state where the flowing substance is in partial contact with the intermediate lubricating vapor layer at all times, resulting in decreased contact between the flowing substance and the underlying surface (e.g., FIGS. 1(*c*) and 1(*d*)).

Intermittent levitation is a state where the flowing substance is in either partial levitation or complete levitation at different times during the transport of the flowing substance, and thus the flowing substance may intermittently contact the underlying surface (e.g., FIGS. 1(*c*) and 1(*d*)). Certain embodiments relate to selecting an appropriate phase-changing material and/or operating conditions to achieve a desired levitation regime of the flowing substance.

Even in absence of complete levitation, the presence of an intermediate lubricating vapor layer decreases the adhesion between the flowing substance and the underlying surface even by making the contact intermittent in nature. Depending upon the mode in which the intermediate layer is formed, localized formation of vapor cushion is possible causing reduction in adhesion forces between the flowing substance and the underlying material. Vapor mechanisms of intermediate layer formation are discussed below.

Generation of Intermediate (Vapor) Layer

The phase-changing material may be a sublimating solid, an evaporating liquid, a composite of a non-sublimating and a sublimating solid, or a composite of evaporating liquid and a non-sublimating solid. Regardless of the phase-changing material composition in the above-mentioned ways, the vapor intermediate layer may be produced by either of the following six mechanisms described below: (1) natural evaporation from a liquid; (2) natural sublimation from a solid; (3) forced evaporation from a liquid by external heating; (4) forced sublimation from a solid by external pressure change; (5) evaporation by contact heat transfer; and (6) sublimation by contact heat transfer.

Natural Evaporation from a Liquid

Evaporation occurs when a liquid substrate (designated by A) at a temperature $T_{liquid}$ is surrounded by a gas mixture (designated by B) with unsaturated vapor component at temperature $T_{surrounding}$. If the diffusion coefficient of the vapor of the substrate liquid in the surrounding gas mixture is $D_{AB}$ $m^2/s$, then the rate of mass transfer to the surrounding is given by $$\dot{m}_c \propto D_{AB}(\rho_A^* - \rho_{A\infty}) \quad (2)$$

where $\rho_{A\infty}$ is the density of vapor at large distances from the liquid substrate, and $\rho_A^*$ is the density of vapor just near the liquid substrate and given by the saturation condition. Examples of such phase-changing liquid materials include acetone, ethanol, various organic liquids, and any combination thereof.

Natural Sublimation from a Solid

Sublimation occurs when a solid substrate changes directly from its solid state to a vapor state at temperatures and pressures below the solid substrate's triple point in the phase diagram. Thus, a solid substrate exposed to a system with pressure P and temperature T, and having a sublimation temperature $T_{sublimation}$ will continuously be converted into vapor. Similar to evaporation from a liquid described above, the rate of mass transfer is given by $\dot{m}_c \propto D_{AB}(\rho_A^* - \rho_{A\infty})$ where $\rho_{A\infty}$ is the density of vapor at large distances from the solid substrate, and $\rho_A^*$ is the density of vapor just near the solid substrate and given by the saturation condition. Examples of such phase-changing solid materials include dry ice (solid carbon dioxide).

Forced Evaporation from a Liquid by External Heating

From Equation 2 above, it can be seen that the rate of evaporation can be increased by increasing the vapor density difference ($\rho_A^* - \rho_{A\infty}$). This is achieved by increasing the saturated conditions of the vapor by increasing the temperature of the liquid $T_{liquid}$ and hence the $\rho_A^*$ . The upper limit of the heating temperature being the boiling temperature of the substrate liquid at the given operating pressure. Thus, by heating the volatile liquid to a higher temperature, the evaporation rate and hence the thickness of the intermediate layer may be increased. Examples of such liquid phase-changing materials include acetone, ethanol, various organic liquids, and any combination thereof.

Forced Sublimation from a Solid by External Pressure Change

From Equation 2 above, it can be seen that the rate of sublimation can be increased by increasing the vapor density difference ($\rho_A^* - \rho_{A\infty}$). This is achieved by decreasing the pressure of the system or increasing a temperature of the phase-changing material. Examples of such materials include Iodine, Naphthalene that directly sublimate upon heating.

Evaporation by Contact Heat Transfer

If a liquid phase-changing material at a temperature $T_{liquid}$ surrounded by a gas mixture at temperature $T_{surrounding}$ is brought into contact with a flowing substance (solid or liquid) such that the flowing substance temperature $T_{material}$ is higher than the boiling point of the liquid phase-changing material $T_{BP}$, then the contact of the two materials may result in a localized phase change of the liquid phase-changing material, thereby creating the vapor layer.

Sublimation by Contact Heat Transfer

If a solid substrate including or coated with a solid phase-changing material at a temperature $T_{solid}$ surrounded by a gas mixture at temperature $T_{surrounding}$ is brought into contact with a flowing substance (solid or liquid), such that the flowing substance temperature $T_{material}$ is higher than the sublimation temperature of the solid phase-changing material, $T_{sublimation}$, then the contact of the two materials may result in a localized phase change of the solid phase-changing material, thereby creating the vapor layer. In embodiments when the flowing substance is a liquid, the flowing substance can be prevented from spreading on the sublimating solid phase-changing material if the freezing point of the flowing liquid is higher than the sublimation temperature of the phase-changing material.

Decreased Adhesion Due to Phase Change of the Underlying Surface

As discussed above, the suspended flowing substance may either be a liquid or a solid object. The underlying solid or liquid surface may either be or may include a phase-changing solid, liquid or a composite of solid and liquid phase-changing materials.

Figure 3:
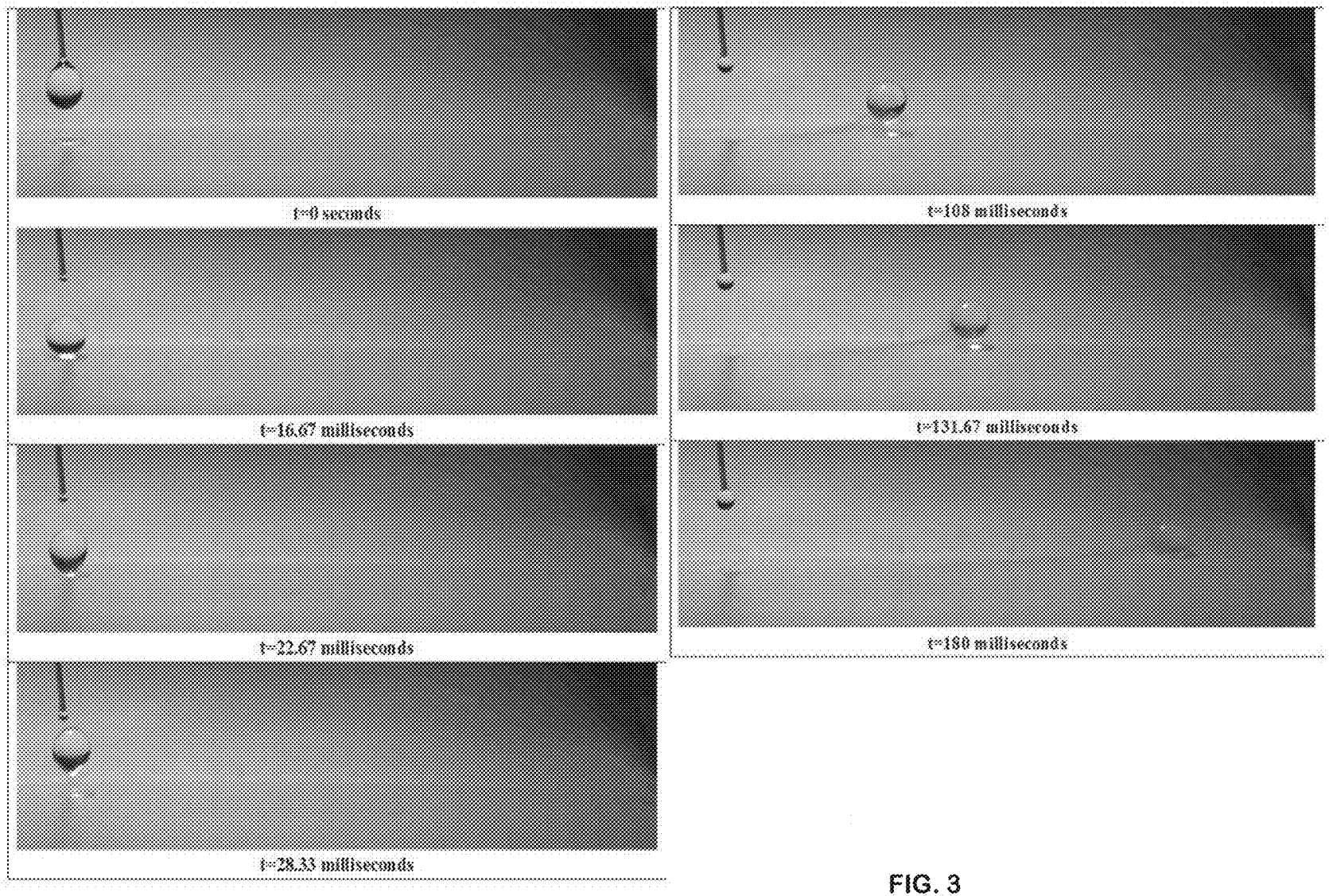
FIG. 3 illustrates a sequence of water droplet impact on dry ice surface imaged at 3000 fps. The volume of the water droplet is roughly 5 μl. As can be seen, the droplet does not adhere to the dry surface, but instead bounces on it and eventually sheds the surface.

FIG. 3 shows a sequence of impacts of a water droplet that has been ejected on the surface of dry ice from a height comparable to the size (diameter) of the droplet. The ejected water droplets are at room temperature, whereas the underlying dry ice surface is sublimating at a constant temperature of about −78° C. as the experiments are carried at room pressure conditions. The sequence shows that water droplets instead of getting frozen instantly interact with the underlying phase-changing dry ice material and result in heat transfer from the water droplet to the underlying phase-changing dry ice material resulting in localized enhanced sublimation of the dry ice. As a result, the dry ice underneath the water droplet gets converted into a vapor layer, which results in a marked decrease in adhesion of water droplets with the dry ice in its original solid state. Since the freezing point of water (0° C.) is higher than the sublimating temperature of dry ice, the water instead of spreading on dry ice remains in a droplet shape. In other words, the sublimation of the dry ice results in the water droplets contacting primarily or only the vapor layer generated by sublimation of the dry ice as opposed to contacting the dry ice in the solid state. As can be seen from the image sequence in FIG. 3, the underlying dry ice surface has a very slight tilt angle (<2°) and the water droplet shows very low adhesion to the underlying dry ice surface, and sheds from the underlying dry ice surface eventually.

Figure 4:
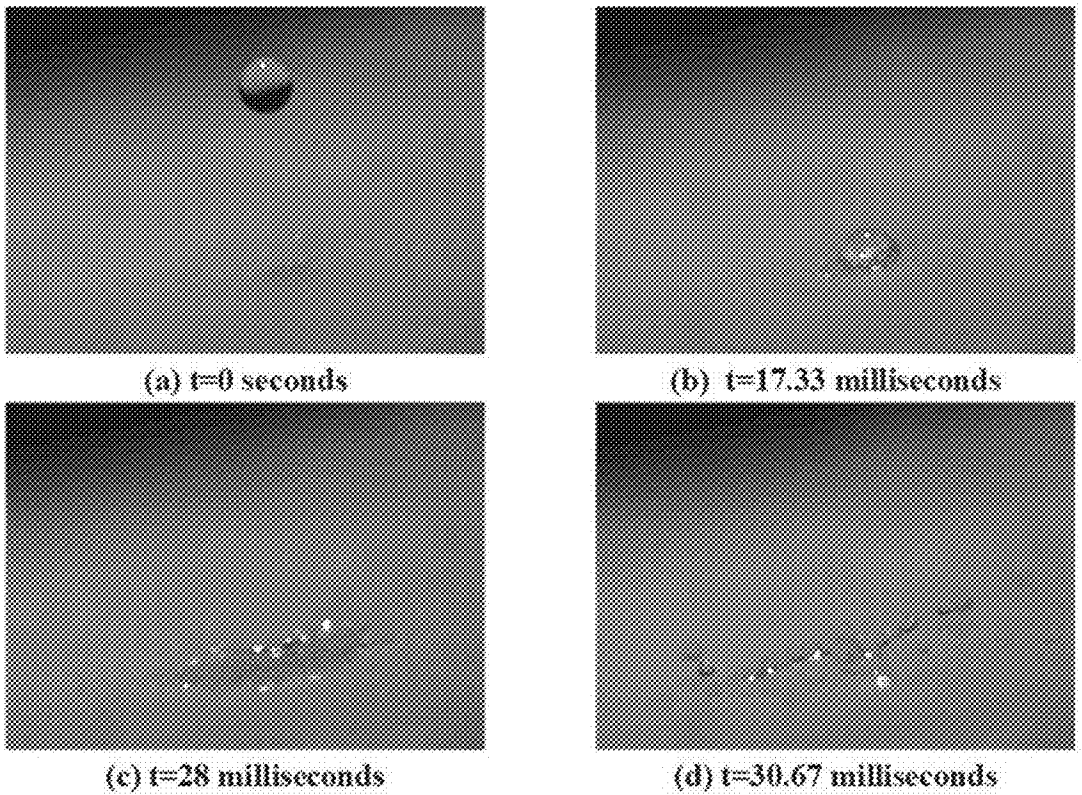
FIG. 4 illustrates a sequence of water droplet impact on dry ice surface imaged at 3000 fps. The volume of the water droplet is roughly 5 μl. The water droplet was ejected at a large distance from the dry ice surface (height from which droplet ejected=20 cm)

FIG. 4 shows water droplet impact behavior on a dry ice surface when the droplet was ejected at large distance (e.g., significantly larger than the diameter of the droplet) away from the dry ice surface (water droplet ejection height=20 cm). The water droplet impacts, spreads, and disintegrates into many smaller droplets that continue to roll on the dry ice surface as shown in FIG. 4. Again, since the freezing point of water (0° C.) is higher than the sublimation temperature of dry ice, the water instead of spreading on dry ice, remains in droplet shape. The conditions under which the flowing substance is introduced over the solid or liquid surface including a phase-changing material differ depending on the desired effect. For certain flowing substances, whether or not the flowing substance impacts, spreads and disintegrates into smaller droplets or particles is insignificant, while it is significant for other applications. Thus, a manner in which the flowing substance is introduced to the surface may be adjusted depending on a desired manner of flow of the flowing substance.

Omniphobicity of a Variety of Liquids

For the working of our idea, it is critical that the intermediate lubricating vapor layer be established either by natural causes (natural evaporation from a liquid or natural sublimation from a solid) or forced causes (forced evaporation from a liquid by external heating or forced sublimation from a solid by external pressure change) or by contact heat transfer (evaporation by contact heat transfer or sublimation by contact heat transfer).

Figure 5:
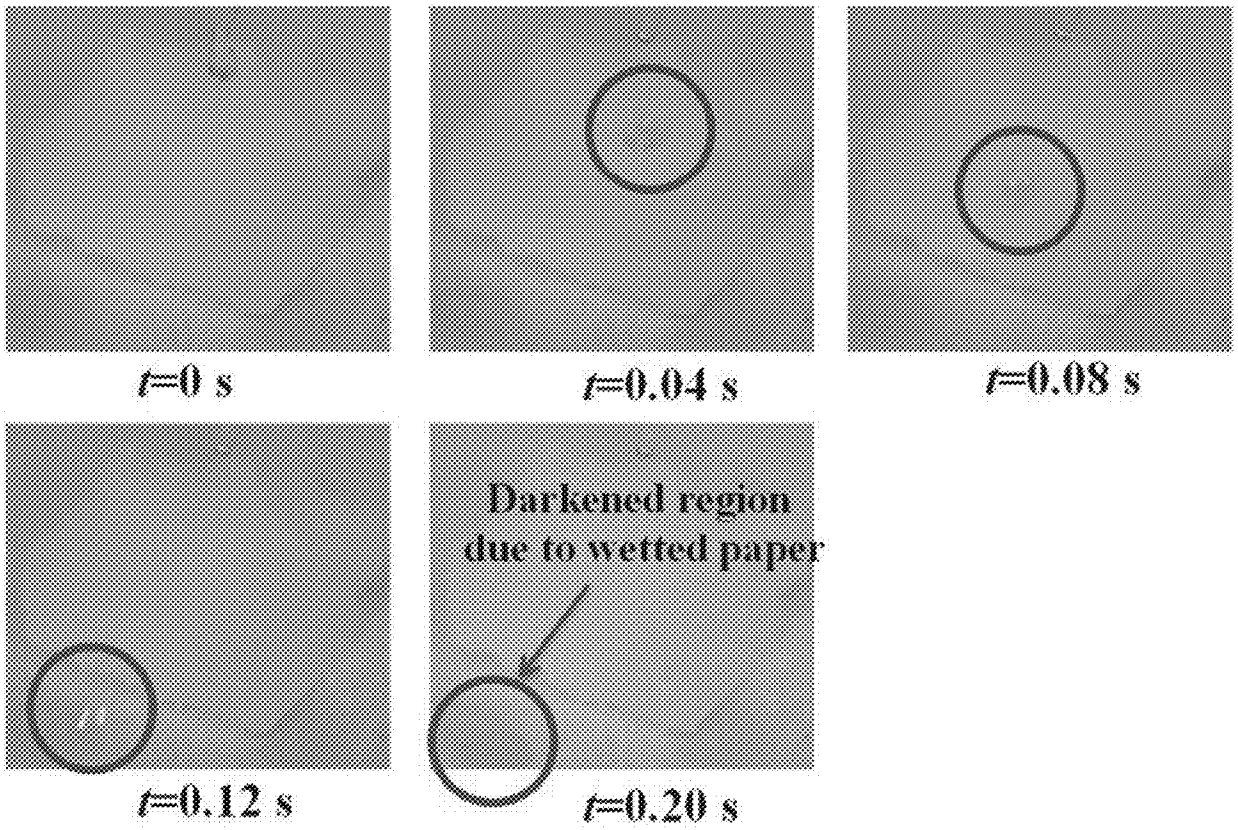
FIG. 5 illustrates a sequence showing motion of an ejected Alpha-Bromonaphthalene droplet on dry ice surface kept on paper imaged at 30 fps. As can be seen from the images, the droplet is very mobile on the surface. After t=0.12 seconds, the droplet leaves the dry ice surface and is absorbed by the paper and the region where the droplet is absorbed appears darker at t=0.20 seconds.
Figure 6:
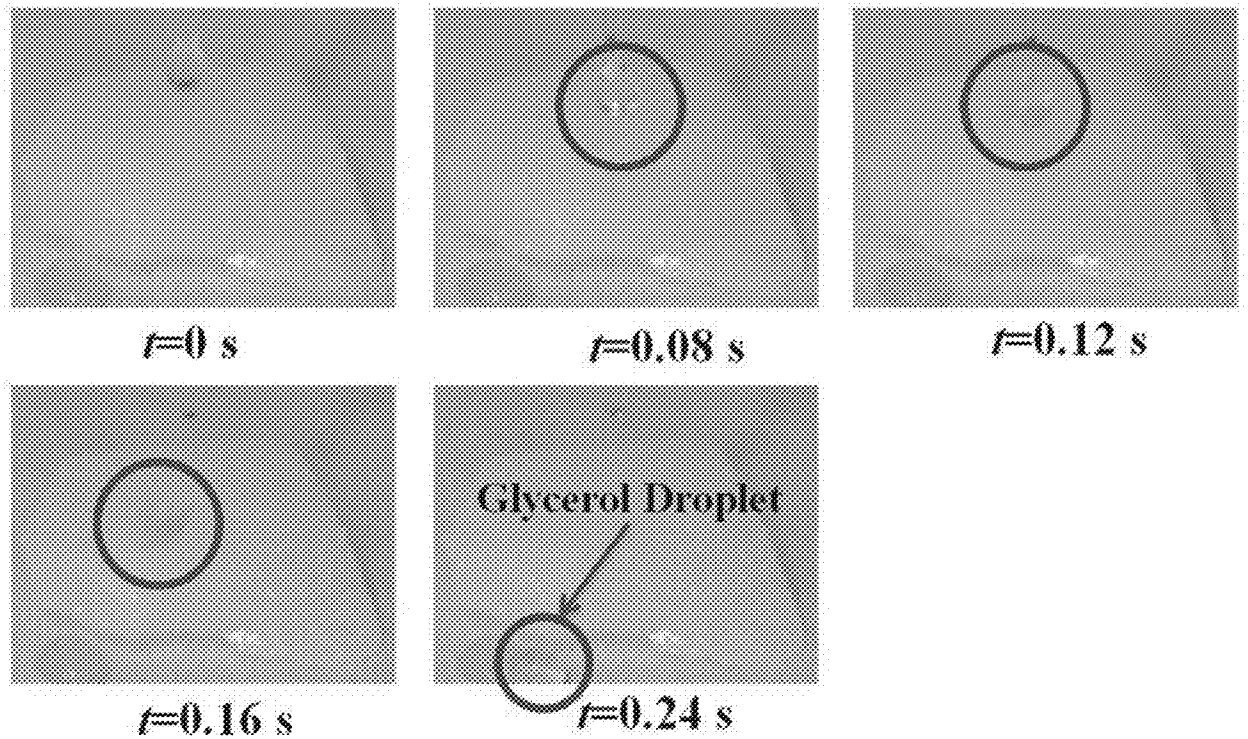
FIG. 6 illustrates a sequence showing motion of an ejected high viscosity glycerol droplet on dry ice surface kept on paper imaged at 30 fps. As can be seen from the images, the droplet is very mobile on the surface. After t=0.16 seconds, the droplet leaves the dry ice surface and is trapped by the paper where it remains as a droplet.

FIGS. 5 and 6 show cases where two materials—alpha-bromonaphthalene and glycerol are ejected on a dry ice surface and their interaction results in contact heat transfer from these suspending materials to dry ice. Each material has a melting point that is higher than the temperature of the dry ice (same as sublimation temperature of dry ice of −78° C.). As a result, both of these materials roll on the dry ice surface instead of spreading.

Figure 7:
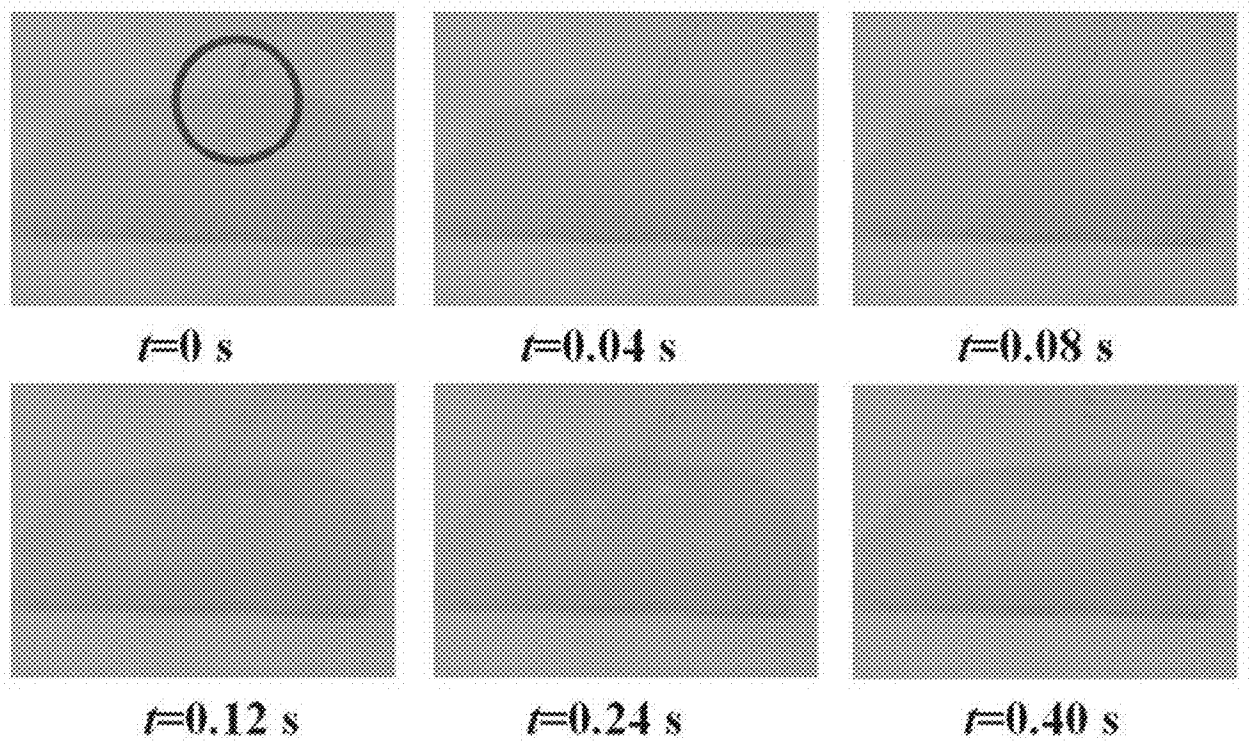
FIG. 7 illustrates a sequence of Tetraethyl orthosilicate jet ejecting on dry ice surface kept on paper imaged at 30 fps. As can be seen from the images, the surrounding paper is not wetted by the organic liquid. Instead it spreads and is absorbed within dry ice. Bubbles nucleate in the spreading liquid due to generation of carbon dioxide from the dry ice surface.
Figure 9C:
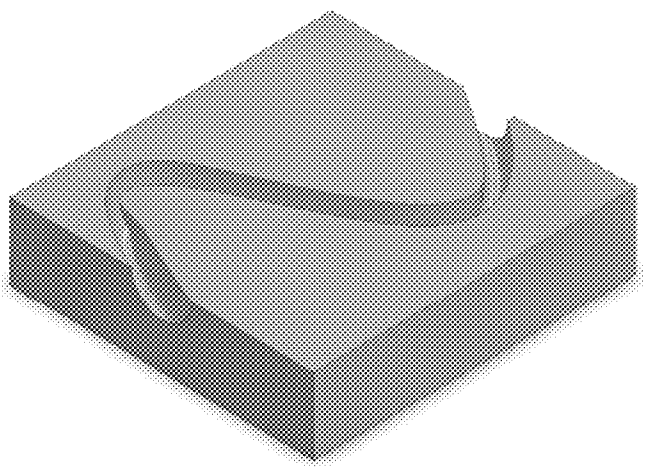
FIG. 9(*a*) illustrates a hemispherical pattern cut out in an underlying surface material.
Figure 9B:
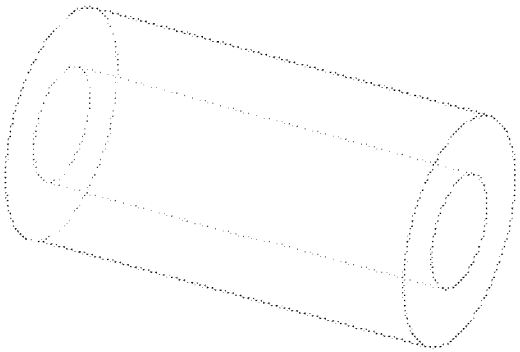
Figure 9A:
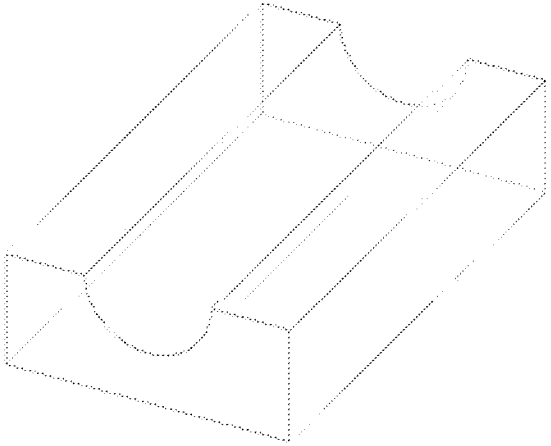

On the other hand, FIG. 7 shows the case where the material—tetraethyl orthosilicate droplet—spreads on dry ice. This liquid has a freezing point (−78° C.) that is comparable to dry ice sublimation temperature. As a result, this liquid cannot transfer sufficient heat to vaporize the dry ice, and it directly spreads on the dry ice. The bubbles that are observed at times after t=0.12 s are formed because of carbon dioxide gas generated by vaporization of dry ice in contact with the flowing substance. A list of various materials that may spread or roll is shown in Table 1 below.

the illustrated pattern was created by forcing a steel disc kept at a higher temperature than dry ice pressed against the dry ice surface. The lateral pressure due to the applied force results in a large amount of sublimation of dry ice under the steel disc. In certain embodiments, the methods to create patterns in or on the underlying surface including or covered with the phase-changing material (e.g., dry ice) include, but are not limited to, pressing, cutting, slicing etc. Various patterned surfaces are shown in FIGS. 9(*a*)-(*c*).

In certain embodiments, where dry ice is the underlying surface or is included on the underlying surface, channels of any desired shapes may be patterned directly on the dry ice material. Contamination is avoided since dry ice produces carbon dioxide that may envelop the flowing substance.

According to another embodiment of the present invention, the surface over which the flowing substance flows may include channels that are substantially V-shaped, substantially U-shaped, or are shaped in any desired manner. Such channels may be useful, for example, to facilitate a chemical reaction. If the channel is substantially V-shaped as the channel shown in FIG. 10, a first flowing substance may be introduced at a corner of a first branch of the substantially V-shaped channel (e.g., location of droplet 1 introduction),

TABLE 1

List of Materials that Spread or Roll Away on Dry Ice

| | CAS | MP ° C. | hfg kJ/kg | hfg + CliqΔT1 | Surface Tension, Liq mN/m or dyn/cm | Dynamic Viscosity, Liq cP | Kinematic Viscosity, Liq cSt | Spreads? |
|---|---|---|---|---|---|---|---|---|
| Tetraethyl orthosilicate | 78-10-4 | −78 | | | | | | Y |
| trichlorovinylsilane | 75-94-5 | −95 | | | | | | Y |
| Hexane | 110-54-3 | −95.16 | 171.057 | 390.1074522 | 17.98091517 | 0.286218927 | 0.43613885 | Y |
| Heptane | 142-82-5 | −90.43 | 140.014 | 365.3677443 | 19.77681872 | 0.402551947 | 0.590530499 | Y |
| Ethyl Acetate | 141-78-6 | −83.7 | 118.947 | 308.7606708 | 23.24044626 | 0.420240359 | 0.470390523 | Y |
| pentane | 109-66-0 | −129.73 | 116.438 | 338.6958283 | 15.46605533 | 0.245270362 | 0.394807534 | Y |
| Ethanol | 64-17-5 | −114.4 | 108 | 336.4596796 | 23.38597471 | 1.041758346 | 1.323400893 | Y |
| Acetone | 67-64-1 | −95 | 97.99 | 313.1729369 | 23.04083028 | 0.31114062 | 0.396011821 | Y |
| Toluene | 108-88-3 | −95 | 71.847 | 239.3461512 | 27.92544186 | 0.565450807 | 0.653932496 | Y |
| CO2 | 124-38-9 | −78 | | | | | | |
| Water | | 0 | 334 | 417.66 | 72 | 0.89 | | N |
| Ethanolamine | 141-43-5 | 10.65 | 335.538 | 368.0345905 | 50.24550288 | 22.16725894 | 21.86773596 | N |
| propylene glycol | 57-55-6 | −60 | 99.48 | 322.6950712 | 35.47006509 | 48.99417181 | 47.4532577 | N |
| Decane | 124-18-5 | −29.51 | 201.849 | 311.0172571 | 23.40590276 | 0.835779944 | 1.147257355 | N |
| Dodecane | 112-40-3 | −9.43 | 216.04 | 281.1068158 | 24.9390154 | 1.357389348 | 1.822018018 | N |
| Tetradecane | 629-59-4 | 5 | 227.176 | 260.3015124 | 26.15179745 | 2.052424839 | 2.708083711 | N |
| Ethylene Glycol | 107-21-1 | −12.4 | 160.436 | 246.8327712 | 49.89191875 | 17.19415434 | 15.49171193 | N |
| Hexadecane | 544-76-3 | 17 | 235.641 | 242.2904979 | 27.0868661 | 3.127040173 | 4.060217401 | N |
| Diethylene glycol | 111-46-6 | −10.3 | 154.54 | 228.3087359 | 49.53865475 | 29.10512223 | 26.12913981 | N |
| formamida | 75-12-7 | 2.55 | 177.171 | 218.8663302 | 59.41123634 | 3.397153179 | 3.008767657 | N |
| Glycerol | 56-81-5 | 18.33 | 198.535 | 202.5046541 | 65.15998508 | 747.1141884 | 594.4756088 | N |
| dimethyl sulfoxide | 67-68-5 | 18.7 | 183.912 | 186.3790333 | 43.78274035 | 2.005994401 | 1.830903246 | N |
| 1234tetrahydronaphthale | 119-64-2 | −35.75 | 94.172 | 185.8649022 | 33.15802758 | 2.046945373 | 2.116575107 | Beads |
| oleic acid | 112-80-1 | 13.53 | 140.193 | 155.8680584 | 32.34042661 | 29.28821752 | 32.98492136 | N |
| bromobenzene | 108-86-1 | −30.72 | 67.684 | 117.8223173 | 35.91432672 | 1.003555172 | 0.674659794 | Beads |
| 1-Bromnaphthalene | 90-11-9 | 6.35 | 73.405 | 88.68826053 | 44.38748057 | 3.713082848 | 2.511937393 | N |
| 1,2,3-tribromopropane | 96-11-7 | 16.19 | 82.17 | 85.0959112 | 46.52288885 | 3.737720492 | 1.550352255 | N |
| Cyclohexane | 110-82-7 | 6.47 | 31.844 | 57.89907132 | 24.6518243 | 0.918205149 | 1.187571686 | N |
| Silicone Oil 1000 cSt | 63148-62-9 | −59 | | | | | | N |

Directed Flow and Patterning of Substrate

Figure 8:
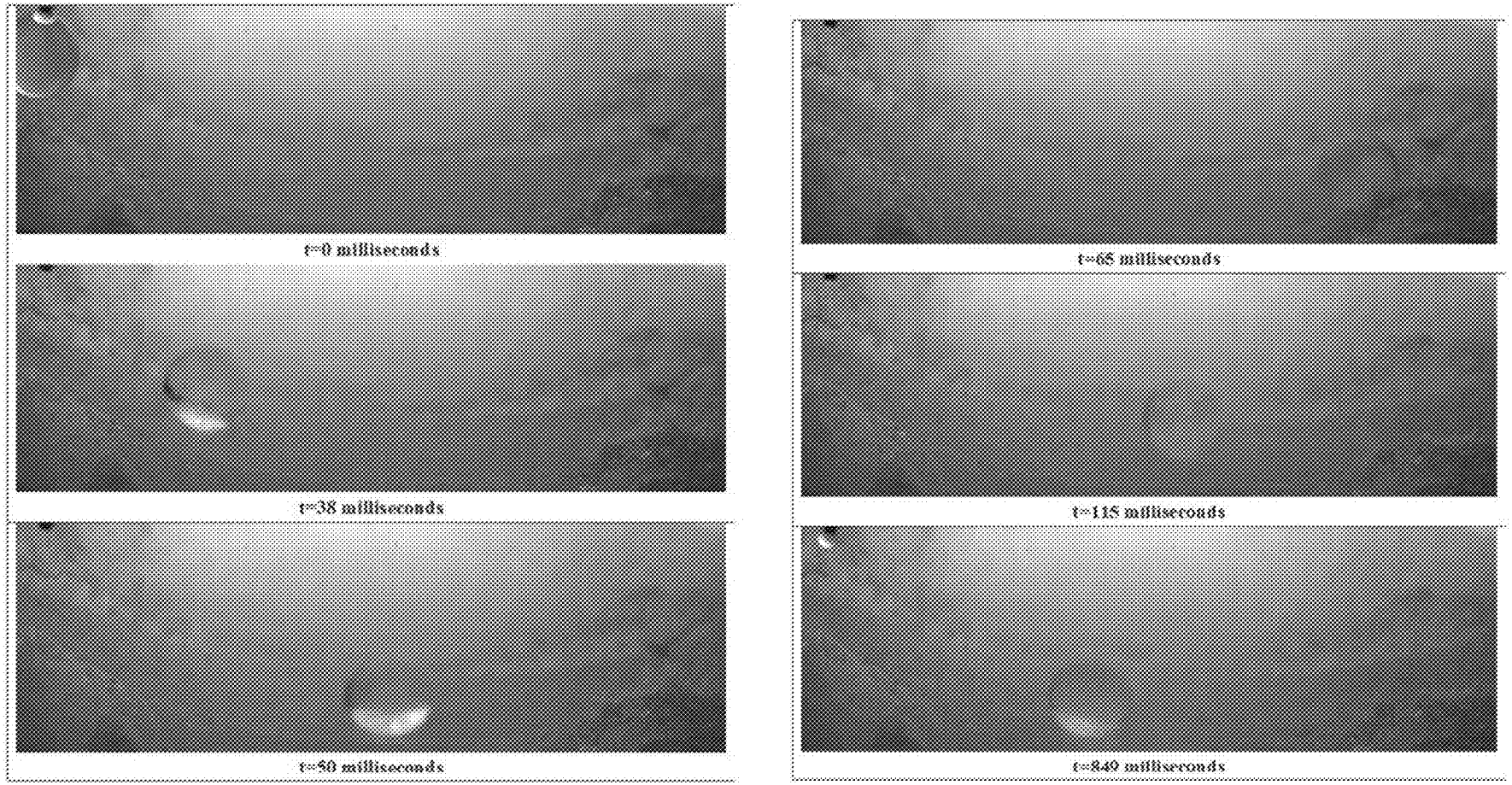
FIG. 8 illustrates a sequence of a water droplet oscillating in an artificially created cavity patterned in dry ice. The pattern was created by forcing a steel disc kept at a higher temperature than dry ice, and pressed against dry ice. The lateral pressure due to the applied force results in very high sublimation of dry ice under the steel disc, thereby creating the cavity for water droplet to oscillate. Channels and cavities of various different shapes may be created.
Figure 10:
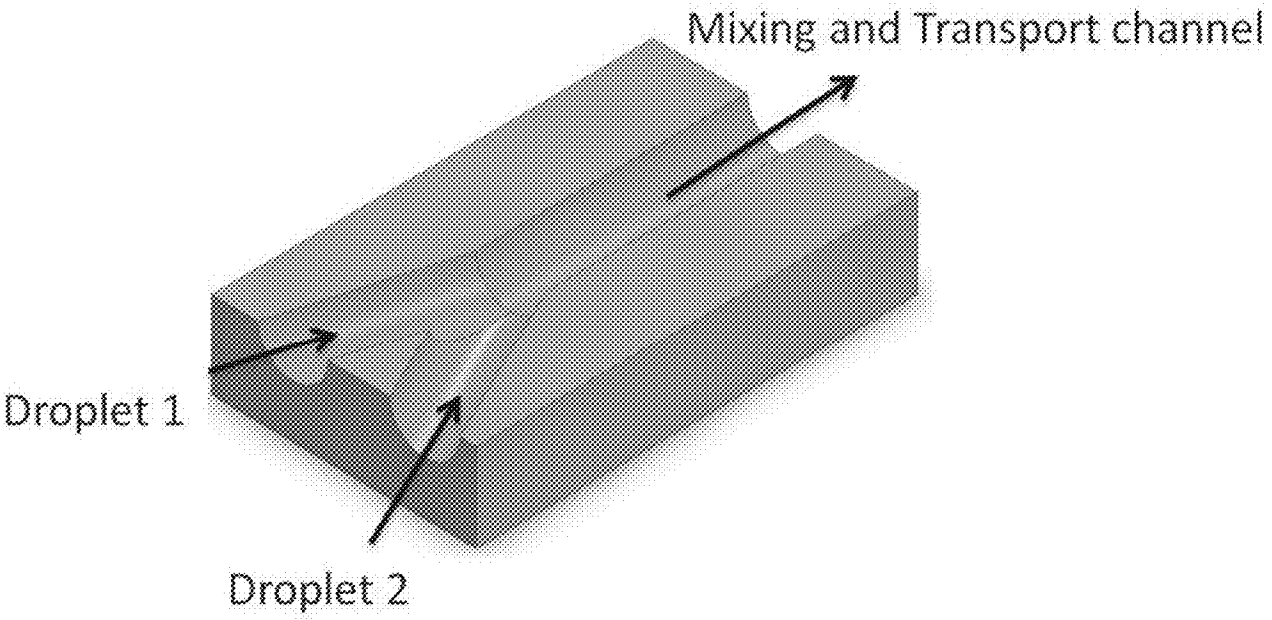
FIG. 10 illustrates a system for facilitating flow of a flowing substance including a minichannel patterned on an underlying surface coated or covered with a phase-changing material. Droplets of two (or more) types of materials are introduced (e.g., via injection) into the system from two different channels. The droplets from the two different channels converge at an intersection point between the two channels, mix, and thereafter move along the transport channel.

In a particular embodiment where the surface includes a sublimating solid (e.g., dry ice) the surface can be patterned to allow the control of movement of a flowing substance thereon. FIG. 8 illustrates a sequence of images of a water droplet oscillating in an artificial minichannel created in dry ice. Patterning of desired shapes may be performed by a variety of methods in order to cause preferential enhanced sublimation. According to one embodiment shown in FIG. 8, and a second flowing substance may be introduced at a corner of a second branch of the substantially V-shaped channel (e.g., location of droplet 2 introduction). The first and second flowing substances may then be directed to flow towards and merge at an apex of the substantially V-shaped channel and then flow along the transport channel as shown in FIG. 10. Certain embodiments relate to merging and reaction of microscopic/nanoscopic quantities of reactants together—since there is no stiction of the flowing substance on the underlying surface.

Achieving Temperature Stabilization of Flowing (Suspended) Substances

The decrease in contact due to formation of an intermediate layer by vaporization of a phase-changing material is based on heat and mass transfer from the phase-changing material in conjunction with its interaction with the flowing substance. This requires a temperature difference between the flowing substance and the phase-changing material when the vaporization rate from the phase-changing material alone is not sufficient to levitate the flowing substance $$\left(\text{e.g., when } U_v < \frac{\rho_d g}{\rho_v} R_d\right).$$

This is particularly important for transporting flowing substances over long distances. The phase-changing material and the flowing substance continuously exchange heat via either direct contact (in case of intermittent or partial levitation) and through the intermediate lubricating vapor layer (in all cases). This results in a decrease in the temperature of the flowing substance to the point where the temperature of the flowing substance and the phase-changing material achieve equilibrium with each other, preventing or disruption the generation of the intermediate lubricating layer, which leads to high adhesion between the flowing substance and the underlying surface including the phase-changing material. Further, when the flowing substance is a liquid or a liquid encapsulating other components, and the phase-changing material is a sublimating solid (e.g., dry ice), reaching the above-referenced equilibrium state will result in freezing of the liquid.

The equilibrium state may be prevented by artificially heating the flowing substance. An example of a system including an artificial heating component (e.g., laser) is shown in FIG. 11.

Figure 11:
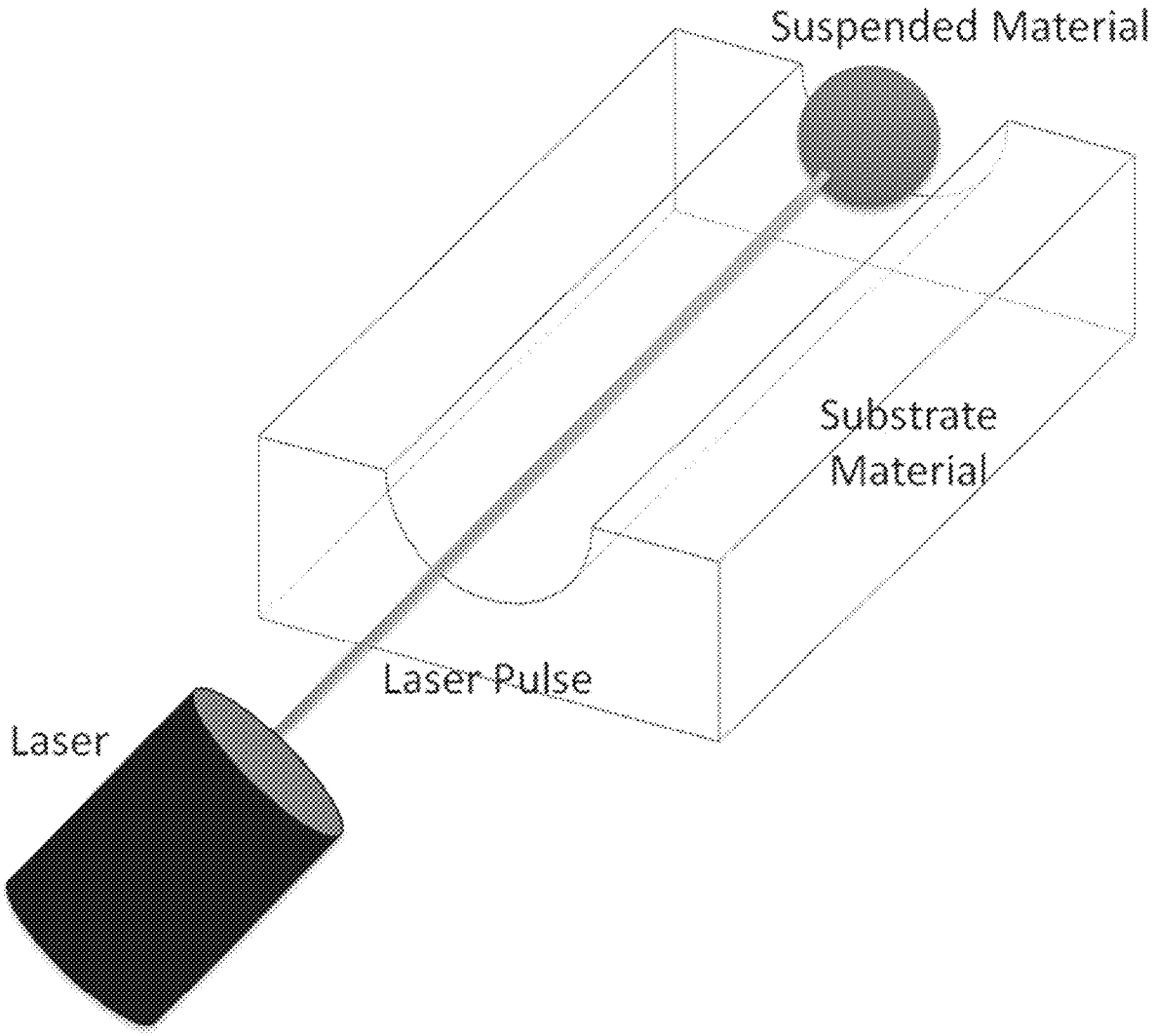
FIG. 11 illustrates artificial heating of a flowing substance material by means of a coaxially located laser supplying thermal energy to the flowing substance.

Referring to FIG. 11, a laser with sufficient power to heat the flowing substance is centered on the transport path of the channel and a droplet is injected in the patterned minichannel. As the droplet interacts with the phase-changing substrate material in either complete, partial, or intermittent levitation mode, the droplet temperature decreases due to heat exchange between the substrate phase-changing material and the flowing substance. However, since the laser pulses are directed towards the flowing substance, the energy from the laser is absorbed by the flowing substance which results in an increase of temperature of the droplet. In an equilibrium state, the laser provides enough energy to the flowing substance to maintain the temperature of the flowing substance at a value that is higher than the temperature of the substrate phase-changing material. The choice of laser power required for maintaining the temperature of flowing substance at an elevated level depends upon multiple factors that include, but are not limited to, the volume of the flowing substance, the transport path length of the minichannel, the temperature of the substrate material, and other factors. Examples of laser types that may be required to achieve this state includes infra-red lasers, Nd:YAG lasers, helium lasers, and other suitable lasers. The minimum power requirement of the laser is about 5 mW, while the upper limit is set by a laser power that can heat the flowing substance without boiling it and/or without disrupting the integrity of the flowing substance. Other mechanisms through which heat can be supplied to the flowing substance include infra-red light and other suitable mechanisms.

Substrate Usage Techniques

In various embodiments, the methods and systems described herein may be used in at least the following two ways: (1) replaceable phase-changing substrates and (2) phase-changing substrates that may be replenished.

Replaceable Substrates

According to one embodiment, the patterned substrate phase-changing material may be used until it is entirely depleted (e.g., by vaporization loss) and may then be replaced by a similarly patterned substrate phase-changing material. This type of system has several advantages. One of the advantages is that vaporization of the phase-changing substrate material enables the creation of a self-cleaning system that requires negligible maintenance. In embodiments where the flowing substances are hazardous in nature (e.g., acids, bases, pathogen encapsulating liquids, etc.), a constantly vaporizing material envelops these hazardous materials and thereby blocks the supply to outside pollutants including oxygen, dust, etc. Moreover, removal of the phase-changing substrate material minimizes the need for environmental cleaning of the phase-changing substrate after transport. Conventional systems, such as systems using regular surfaces not coated with materials promoting flow of the flowing substances, require multiple cleaning operations before and/or after transport of the flowing substances. Such cleaning operations include acetone wash, DI water wash, etc, These operations create organic waste, the disposal and management of which requires a significant amount of monetary and time expenditures.

Substrate Material is Replenished

In certain embodiments, particularly where the phase-changing substrate material is a liquid, the replenishment of the phase-changing material can be accomplished by means of providing micro/nano textures on the solid substrate holding the phase-changing liquid. Particularly in embodiments where liquid impregnated surfaces are employed, this replenishment can be achieved by tuning the texture properties, and by other means such as providing an artificial reservoir of the volatile liquid close to the textured substrate such that a part of the textured substrate is in contact with such a reservoir, so that the volatile liquid can wick into the textured substrate by capillary action.

Figure 12:
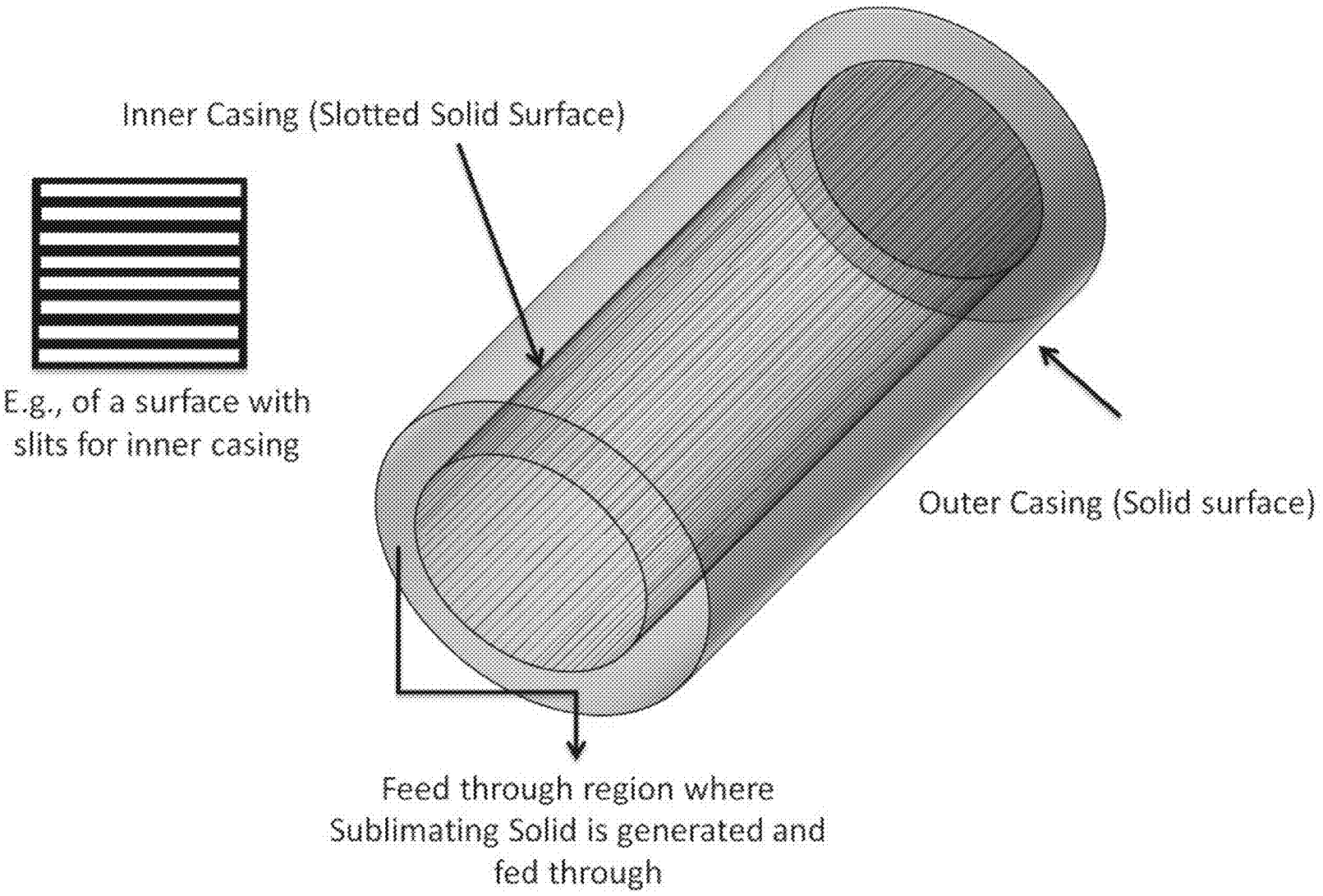
FIG. 12 illustrates an example of an embodiment for making an encapsulated article using a phase-changing material. The embodiment illustrates two concentric tubes—an outer casing (solid surface) and an inner casing (slotted solid surface). The outer casing is a solid surface that provides strength to hold the entire article. The inner casing is a perforated tube through which the phase changing material is pushed towards the interior of the tube. The region between the outer and the inner casing is initially empty and is maintained at a constant separation distance that is denoted as the "feed through region." The sublimating substrate material is generated or delivered from outside of the encapsulated article and then delivered to the article through the feed through region where, because of compression between the two concentric tubes, the phase-changing material flows towards an interior of the tube through the perforations of the inner casing, eventually forming a composite.

In embodiments where the phase changing material is a sublimating substrate (e.g., dry ice), dry ice can be generated in-situ. The solid substrate may include perforations (holes, slits, etc.) at its bottom to sustain pressures required for generation of sublimating solids that are squeezed through such perforations and eventually rise to reach an equilibrium level within the solid. An example of such an embodiment is shown in FIG. 12.

Specifics of Phase-Changing Material

Some common desirable requirements for the surfaces useful according to embodiments of the present invention include both the phase-changing material as well as its vapor being unreactive and immiscible with the flowing substance and with the solid substrate over which the surface including the phase-changing material(s) may be positioned or which holds the phase-changing material. Further, the choice of the phase-changing material(s) for such applications will depend upon the thermodynamic conditions. Suitable liquids for the phase-changing material can be obtained that have large vapor pressure (high volatility). These liquids can further be heated so as to increase vapor flux, and the supplied heat is such that these liquids never attain their flash point to avoid combustion or related unwanted phenomena to occur.

Some common liquids that can be used as the phase-changing material when the flowing substance is water are: kerosene, dichloromethane, etc. Some common solids that can be used as the phase-changing material when the flowing substance is water include dry ice, camphor, dry nitrogen.

Examples of Flowing Substances (Suspended Materials)

The flowing substance is non-reactive towards and immiscible with the substrate phase-changing material (in solid, liquid, or vapor phase). Examples of suitable flowing substances include organic liquids (examples of such liquids is provided in Table 1 above), water, any compatible solids, nanofluids, biofluids (e.g., plasma, blood, etc.), liquids containing or encapsulating other components (e.g., pathogens, antibodies, viruses, cell cultures, nucleic acids, etc.), compatible acids, and compatible bases (including those provided in Table 1 above). The methods described herein are capable of reducing adhesion of a large variety of liquids, including low surface tension liquids, high viscosity liquids, etc.

Additional Applications

As discussed above, the present invention may be used in a variety of applications and industries where contact between materials is of concern.

According to one embodiment, the present invention may be used in pharmaceutical and drug related industries to carry out in-situ chemical reactions. As described above, a channel of a desired shape (e.g., substantially U-shape or V-shape) may be carved out in the solid or liquid surface including the phase-changing material (e.g., dry ice). Two flowing substances may then be introduced into opposing points (e.g., opposing corners of the substantially V-shaped channel), and the two flowing substances may be configured to travel towards a central or merging point (e.g., apex of the substantially V-shaped channel) to merge, mix, and to then be transported to a desired location. The dry ice (or the phase-changing material that is used) may be replenished by a replenishing chamber as needed at any point during the reaction. According to certain other embodiments, an underlying surface that is coated, covered, or patterned with a phase-changing material may be used only until the phase-changing material is entirely depleted, and the underlying surface may then be replaced with a new similarly coated, covered, or patterned underlying surface.

Vaporization of the phase-changing materials enables the creation of self-cleaning systems which require negligible maintenance. In contrast, conventional methods require regular cleaning of the underlying surfaces, tubes, assemblies, etc.

According to a further aspect of the present invention, the present invention may be used in microfluidic and/or bio-related applications. For example, nano- or picoliter-sized droplets can encapsulate biology (e.g., DNA or RNA) where single-plex polymerase chain reactions (PCRs) are performed in each droplet, and the droplets are transported for sorting, detection, etc. The volume of each droplet may range between, e.g., 0.1-1000 pL; 1-10 pL; 1-100 pL, or any other suitable size for bio-related applications.

The present invention may also be used in continuous-flow microfluidics, digital microfluidics, DNA chips, molecular biology applications, study of evolutionary biology study of microbial behavior, cellular biophysics, optofluidics, fuel cell applications, acoustic droplet ejection, and all other suitable microfluidic applications. Aspects of the present invention may be used for enzymatic analysis, DNA analysis, molecular biology applications (e.g., various electrophoresis and liquid chromatography applications for proteins and DNA, cell separation, including separation of blood cells, cell manipulation and analysis, including cell viability analysis).

Aspects of the present invention also relate to oil and gas applications, and in particular to liquid transportation through pipes, which requires huge pumping power, especially when done over long distances. By suitably choosing the vaporizing/sublimating material (which may encapsulate the solid substrate such as a pipe), large slip can be induced by eliminating the contact line pinning at solid interface, thereby drastically reducing drag and pumping power. According to certain embodiments, water could line the walls of pipelines. Oil that is forced into pipelines is heated, and this heat causes the water lining or a part of the water lining to evaporate, thus creating a vapor layer underneath. This greatly reduces the drag on the flowing oil and reduces the required pumping power.

Aspects of the present invention may also be used for transporting chemicals/liquids in sealed environments without contact with solid surface.

Aspects of the present invention may also be used for aircraft and utilities applications. Since surfaces encapsulated or coated with a vaporizing/sublimating material result in diminished ice/frost adhesion, the energy and environmentally harmful chemicals required to device aircraft wings can be significantly reduced. Similarly, ice from power transmission lines can be easily removed. Icing can be significantly reduced on wind turbines as well, therefore increasing their efficiency.

Embodiments of the present invention may also be used for steam and gas turbines. Water droplets entrained in steam impinge on turbine blades and stick to them, thereby reducing turbine power output. By encapsulating a phase-changing material in a surface or by coating or applying such a phase-changing material onto the surface, droplets can be shed off the blades, and turbine power output can be significantly improved.

Similar to ice adhesion challenges, surfaces encapsulated or coated with phase-changing materials can also be used to reduce adhesion of natural gas hydrates in oil and gas pipelines to reduce hydrate plug formation in deep sea applications. These surfaces can also be applied for reducing scaling (salt formation and adhesion).

EQUIVALENTS

While the invention has been particularly shown and described with reference to specific preferred embodiments, it should be understood by those skilled in the art that various changes in form and detail may be made therein without departing from the spirit and scope of the invention as defined by the appended claims.

What is claimed is:

1. A method of facilitating flow of a flowing substance on a surface comprising a phase-changing material, the method comprising:

providing a surface comprising the phase-changing material having a melting temperature and/or sublimation temperature at operating pressure lower than the flowing substance temperature; and introducing the flowing substance onto the surface, thereby causing at least a portion of the phase-changing material to locally transition from a first state to a second state, thereby forming a lubricating intermediate layer between the flowing substance and the surface, wherein the phase-changing material is a liquid or a solid in the first state and a vapor in the second state.

2. The method of claim 1, wherein the surface is impregnated with the phase-changing material, the surface comprising a matrix of features spaced sufficiently close to stably contain the phase-changing material therebetween or therewithin.

3. The method of claim 1, wherein the flowing substance is a droplet.

4. The method of claim 3, further comprising the step of encapsulating biological matter into the droplet.

5. The method of claim 4, wherein the biological matter comprises DNA and/or RNA.

6. The method of claim 3, wherein the droplet has a volume in a range from between 0.1 pL to 1000 pL.

7. The method of claim 1, wherein the flowing substance is a solid at operating conditions.

8. The method of claim 1, wherein the flowing substance is a liquid at operating conditions.

9. The method of claim 1, wherein the flowing substance is a stream of liquid.

10. The method of claim 1, wherein the flowing substance is a stream of droplets.

11. The method of claim 1, wherein the surface is a coating on a substrate.

12. The method of claim 1, wherein a surrounding gas has a temperature that is lower than the melting temperature and/or sublimation temperature of the phase-changing material, so that the phase-changing material substantially remains in the first state in locations other than locations in contact with the flowing substance.

13. The method of claim 1, wherein the surface forms a channel over which or through which the flowing substance flows.

14. The method of claim 1, further comprising replenishing a supply of the phase-changing material.

15. The method of claim 1, wherein the phase-changing material is a liquid selected from kerosene, dichloromethane, acetone, ethanol, iodine, and naphthalene.

16. The method of claim 1, wherein the phase-changing material is dry ice.

17. The method of claim 1, wherein the phase-changing material is a solid selected from camphor and dry nitrogen.

18. The method of claim 1, wherein a volume of the flowing substance remains constant during transport.

19. The method of claim 1, wherein the phase-changing material in the first state and in the second state is unreactive and immiscible with the flowing substance.

20. The method of claim 1, wherein the surface is microtextured.

21. The method of claim 1, wherein the surface comprises the at least one phase-changing material positioned in a selected pattern, wherein the flowing substance flows over the surface according to the selected pattern.

22. The method of claim 21, wherein the pattern is a substantially V-shaped pattern, the method further comprising introducing a second flowing substance onto the surface, wherein the flowing substance and the second flowing substance flow along different branches of the substantially V-shaped pattern, the flowing substance and the second flowing substance merging at an apex of the substantially V-shaped pattern.

23. The method of claim 1, wherein the flowing substance is in contact only with the phase-changing material in the second state during transport.

24. The method of claim 1, wherein the flowing substance is a liquid having a melting and/or sublimation point that is higher than the melting and/or sublimation point of the phase-changing material.

25. A method of facilitating flow of a flowing substance on a surface comprising a phase-changing material, the method comprising:

providing a surface comprising the phase-changing material having a melting temperature and/or sublimation temperature at operating pressure lower than the flowing substance temperature; and introducing the flowing substance onto the surface, thereby causing at least a portion of the phase-changing material to locally transition from a first state to a second state, thereby forming a lubricating intermediate layer between the flowing substance and the surface, wherein the phase-changing material is dry ice.

26. A method of facilitating flow of a flowing substance on a surface comprising a phase-changing material, the method comprising:

providing a surface comprising the phase-changing material having a melting temperature and/or sublimation temperature at operating pressure lower than the flowing substance temperature; and introducing the flowing substance onto the surface, thereby causing at least a portion of the phase-changing material to locally transition from a first state to a second state, thereby forming a lubricating intermediate layer between the flowing substance and the surface, wherein a volume of the flowing substance remains constant during transport.

* * * * *